US006636187B2

(12) United States Patent
Tajima et al.

(10) Patent No.: US 6,636,187 B2
(45) **Date of Patent: *Oct. 21, 2003**

(54) DISPLAY AND METHOD OF DRIVING THE DISPLAY CAPABLE OF REDUCING CURRENT AND POWER CONSUMPTION WITHOUT DETERIORATING QUALITY OF DISPLAYED IMAGES

(75) Inventors: Masaya Tajima, Kawasaki (JP); Junichi Okayasu, Kawasaki (JP); Kiyoshi Takata, Kawasaki (JP); Katsuhiro Ishida, Kawasaki (JP); Takashi Fujisaki, Kawasaki (JP); Yoshimasa Awata, Kawasaki (JP); Nobuyoshi Kondo, Kawasaki (JP); Shinsuke Tanaka, Kawasaki (JP); Naoki Matsui, Kawasaki (JP); Fumitaka Asami, Kawasaki (JP)

(73) Assignee: Fujitsu Limited, Kawasaki (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/181,648

(22) Filed: Oct. 29, 1998

(65) Prior Publication Data

US 2001/0040536 A1 Nov. 15, 2001

(30) Foreign Application Priority Data

Mar. 26, 1998 (JP) ..... 10-079660

(51) Int. Cl.[7] ..... G09G 3/20

(52) U.S. Cl. ..... 345/55; 345/60; 345/63; 345/89; 345/98; 345/99; 345/68; 345/213; 345/214; 345/100; 348/441; 348/443; 348/446; 348/454; 348/456; 348/455

(58) Field of Search ..... 345/55, 60, 63, 345/89, 204, 213, 98, 100, 103, 99, 68, 66, 62, 214; 348/441, 443, 446, 454, 455, 456

(56) References Cited

U.S. PATENT DOCUMENTS 4,691,144 A * 9/1987 King et al. ..... 315/169.3
4,975,691 A * 12/1990 Lee ..... 340/781

(List continued on next page.)

FOREIGN PATENT DOCUMENTS

EP 0655722 A1 1/1994
EP 0655725 A1 11/1994

(List continued on next page.)

OTHER PUBLICATIONS

Korean Patent Application No. 10–1998–0049168, Office Action dated Oct. 12, 2000.

(List continued on next page.)

*Primary Examiner*—Richard Hjerpe
*Assistant Examiner*—Ali Zamani
(74) *Attorney, Agent, or Firm*—Staas & Halsey LLP

(57) ABSTRACT

A display has a panel, and first and second electrodes. The first and second electrodes define a matrix of cells on the panel. The second electrodes, which correspond to lines of the cells, are scanned to select the cell lines one by one. The first electrodes are driven to set display data for a selected one of the cell lines. The display also has a sequence setting unit for setting sequences of scanning the second electrodes, and a sequence selection unit for selecting one of the sequences that minimizes the current and power consumption of a first-electrode driver without deteriorating the quality of the displayed images.

36 Claims, 27 Drawing Sheets

U.S. PATENT DOCUMENTS

| | | | | | |
|---|---|---|---|---|---|
| 5,689,278 | A | | 11/1997 | Barker et al. | |
| 5,717,467 | A | * | 2/1998 | Shiki | 345/121 |
| 5,889,502 | A | * | 3/1999 | Iwama | 345/60 |
| 5,973,655 | A | * | 10/1999 | Fujisaki et al. | 345/63 |
| 5,986,649 | A | * | 11/1999 | Yamazaki | 345/211 |
| 5,999,154 | A | * | 12/1999 | Yoshioka | 345/89 |
| 6,002,381 | A | * | 12/1999 | Tomio et al. | 345/60 |
| 6,025,818 | A | * | 2/2000 | Okano | 345/63 |
| 6,208,323 | B1 | * | 3/2001 | Ito et al. | 345/100 |
| 6,232,951 | B1 | * | 5/2001 | Miyamoto | 345/132 |
| 6,252,572 | B1 | * | 6/2001 | Kurumisawa et al. | 345/98 |
| 6,252,573 | B1 | * | 6/2001 | Ito et al. | 345/100 |
| 6,329,981 | B1 | * | 12/2001 | Lin et al. | 345/204 |

FOREIGN PATENT DOCUMENTS

| | | |
|---|---|---|
| JP | 61-144698 | 7/1986 |
| JP | 63-005390 | 1/1988 |
| JP | 63-262688 | 10/1988 |
| JP | 07044127 A | 2/1995 |
| JP | 07-064512 | 3/1995 |
| JP | 08-62573 | 3/1996 |
| JP | 08-123362 | 5/1996 |
| JP | 08305320 | 11/1996 |
| JP | 09-330054 | 12/1997 |

OTHER PUBLICATIONS

Korean Unexamined Patent Publication No. 97–17861.
Notice of Reasons for Rejection for related Japanese Application No. 10–079660 dated Jun. 4, 2002.

* cited by examiner

Fig.12A

[CHECKERED PATTERN]

DATA (DISPLAY PATTERN)

| | A1 | A2 | A3 | A4 |
|---|---|---|---|---|
| Y1 | 1 | 0 | 1 | 0 |
| Y2 | 0 | 1 | 0 | 1 |
| Y3 | 1 | 0 | 1 | 0 |
| Y4 | 0 | 1 | 0 | 1 |

Fig.12B

CHANGES IN A-ELECTRODES IN SCAN SEQUENCE 1

| | SCAN SEQUENCE Y1 → Y2 → Y3 → Y4 | CHANGES |
|---|---|---|
| A1 | 1 → 0 → 1 → 0 | 3 |
| A2 | 0 → 1 → 0 → 1 | 3 |
| A3 | 1 → 0 → 1 → 0 | 3 |
| A4 | 0 → 1 → 0 → 1 | 3 |
| | TOTAL | 12 |

Fig.12C

CHANGES IN A-ELECTRODES IN SCAN SEQUENCE 2

| | SCAN SEQUENCE Y1 → Y3 → Y2 → Y4 | CHANGES |
|---|---|---|
| A1 | 1 → 1 → 0 → 0 | 1 |
| A2 | 0 → 0 → 1 → 1 | 1 |
| A3 | 1 → 1 → 0 → 0 | 1 |
| A4 | 0 → 0 → 1 → 1 | 1 |
| | TOTAL | 4 |

Fig.13A

[TWO-LINE CHECKERED PATTERN]

DATA (DISPLAY PATTERN)

| | A1 | A2 | A3 | A4 |
|---|---|---|---|---|
| Y1 | 1 | 0 | 1 | 0 |
| Y2 | 1 | 0 | 1 | 0 |
| Y3 | 0 | 1 | 0 | 1 |
| Y4 | 0 | 1 | 0 | 1 |

Fig.13B

CHANGES IN A-ELECTRODES IN SCAN SEQUENCE 1

| | SCAN SEQUENCE Y1 → Y2 → Y3 → Y4 | CHANGES |
|---|---|---|
| A1 | 1 → 1 → 0 → 0 | 1 |
| A2 | 0 → 0 → 1 → 1 | 1 |
| A3 | 1 → 1 → 0 → 0 | 1 |
| A4 | 0 → 0 → 1 → 1 | 1 |
| | TOTAL | 4 |

Fig.13C

CHANGES IN A-ELECTRODES IN SCAN SEQUENCE 2

| | SCAN SEQUENCE Y1 → Y3 → Y2 → Y4 | CHANGES |
|---|---|---|
| A1 | 1 → 0 → 1 → 0 | 3 |
| A2 | 0 → 1 → 0 → 1 | 3 |
| A3 | 1 → 0 → 1 → 0 | 3 |
| A4 | 0 → 1 → 0 → 1 | 3 |
| | TOTAL | 12 |

Fig.16

| | A1 | A2 | A3 | | | | | | | | | | | A15 | A16 |
|---|---|---|---|---|---|---|---|---|---|---|---|---|---|---|---|
| Y1 | × | × | × | ○ | ○ | × | ○ | ○ | × | ○ | ○ | × | × | × | × |
| Y2 | × | × | ○ | × | × | ○ | × | × | ○ | × | × | ○ | × | ○ | ○ |
| Y3 | × | × | ○ | × | × | ○ | × | × | ○ | × | × | ○ | ○ | × | ○ |
| | × | ○ | ○ | ○ | ○ | ○ | ○ | ○ | ○ | ○ | ○ | × | ○ | × | ○ |
| | ○ | × | × | × | ○ | × | × | × | × | × | × | ○ | ○ | ○ | × |
| | ○ | × | × | ○ | × | × | ○ | ○ | ○ | ○ | × | × | ○ | × | ○ |
| | × | ○ | ○ | ○ | × | ○ | × | × | × | × | ○ | × | ○ | × | ○ |
| | ○ | × | × | ○ | × | ○ | × | ○ | ○ | × | ○ | × | ○ | ○ | × |
| | ○ | × | × | ○ | × | ○ | × | ○ | ○ | × | ○ | × | ○ | × | ○ |
| | × | ○ | ○ | ○ | × | ○ | × | × | × | × | ○ | × | ○ | × | ○ |
| | ○ | × | × | ○ | × | × | ○ | ○ | ○ | ○ | × | × | ○ | ○ | × |
| | ○ | × | × | ○ | ○ | × | × | × | × | × | × | ○ | × | × | ○ |
| | × | ○ | ○ | × | ○ | ○ | ○ | ○ | ○ | ○ | ○ | ○ | × | × | ○ |
| | × | × | × | ○ | × | × | ○ | × | × | ○ | × | × | ○ | ○ | × |
| Y15 | × | × | × | ○ | × | × | ○ | × | × | ○ | × | × | ○ | × | × |
| Y16 | × | × | × | × | ○ | ○ | × | ○ | ○ | × | ○ | ○ | × | × | × |

DISPLAY AND METHOD OF DRIVING THE DISPLAY CAPABLE OF REDUCING CURRENT AND POWER CONSUMPTION WITHOUT DETERIORATING QUALITY OF DISPLAYED IMAGES

BACKGROUND OF THE INVENTION

1. Field of the Invention

The present invention relates to displays and a method of driving a display, and more particularly to displays having a matrix of electrodes that is scanned line by line to set display data, such as plasma display panels (PDPs), electroluminescence (EL) panels, and liquid-crystal displays (LCDs), and a method of driving such displays.

2. Description of the Related Art

Displays such as PDPs, EL panels, and liquid-crystal displays are getting larger in size and capacity and acquiring full-color display capabilities. As a result, the power consumption of the displays is increasing. It is necessary to minimize the power consumption of the displays.

For example, in a three-electrode surface-discharge alternating-current plasma display panel (3-electrode, surface-discharge AC PDP), a frame is divided into a plurality of sub-frames, in order to display gradations on the PDP. These sub-frames have respective sustain periods whose lengths differ from one another to display gradation levels in combination, and each sub-frame consists of a reset period, an addressing period, and a sustain period. The reset period sets all of the Y-electrodes and applies write pulses to all of the addressing electrodes and X-electrodes. As a result, every cell causes a discharge and neutralizes itself (self-erase discharge).

In the prior art, the Y-electrodes have only been sequentially scanned and this sequence has never been changed. Further, the resolution of displays, i.e., the number of lines on the screen of a display has been increased to increase electrode-to-electrode capacitance.

Power consumption to charge and discharge the electrodes occupies a large part of the power consumption of the PDP. Therefore, the power required to charge and discharge the electrodes must be reduced to minimize the power consumption.

The power required to charge and discharge electrodes is determined by the capacitance, driving voltage, and driving frequency of the electrodes. Among them, only the driving frequency is controllable. A conventional technique drops the driving frequency by masking display data or by reducing the number of sub-frames in each frame. This technique results in reducing the number of gradation levels to be displayed, thereby deteriorating the quality of images to be displayed.

Prior arts and the problems thereof will be explained later with reference to accompanying drawings.

SUMMARY OF THE INVENTION

An object of the present invention is to provide a display capable of reducing its current and power consumption without deteriorating the quality of displayed images, and a method of driving such a display.

According to the present invention, there is provided a display having a panel, and first and second electrodes; the first and second electrodes defining a matrix of cells on the panel; the second electrodes, which correspond to lines of the cells, being scanned to select cell lines one by one; the first electrodes being driven to set display data for a selected one of the cell lines, wherein the display comprises a sequence setting unit for setting sequences of scanning the second electrodes; and a sequence selection unit for selecting one of the sequences.

The display may further comprise a difference detection unit for detecting differences between display data set for the cell lines so that one of the sequences that minimizes the differences is selected. The display may further comprise a difference detection unit for detecting differences between display data set for the cell lines; and an upper limit setting unit for setting an upper limit so that one of the sequences that suppresses the differences to below the upper limit is selected. The sequences may be set based on powers of two. The sequence setting unit may divide the second electrodes into blocks and set sequences of scanning the second electrodes block by block; and the sequence selection unit may select one of the sequences in each of the blocks.

The first electrodes may be addressing electrodes, and the second electrodes may be scan electrodes. The display may further comprise an address driver for driving the addressing electrodes; a current/power value detection unit for detecting a current or power value of the address driver; and a sequence changing unit for changing a sequence of scanning the second electrodes to minimize the current or power value.

The display may further comprise a current/power value evaluation unit for evaluating a current or power value of the address driver according to display data set for the cell lines so that one of the sequences that minimizes the current or power value is selected. The display may further comprise a reference value setting unit for setting a reference value so that one of the sequences that suppresses the current or power value to below the reference value is selected.

The display may further comprise a current/power value evaluation unit for evaluating a current or power value of the address driver according to display data set for the cell lines; and a reference value setting unit for setting a reference value so that one of the sequences that suppresses the current or power value to below the reference value is selected. The display may further comprise a current/power value evaluation unit for evaluating a current or power value of the address driver beforehand according to display data set for the cell lines; and a reference value setting unit for setting a reference value so that one of the sequences that suppresses the current or power value to below the reference value is selected. The display may further comprise a display data supplying unit for supplying display data line by line to the first electrodes according to the selected sequence of scanning the second electrodes.

The display may be a plasma display; a frame of display data may be divided into a plurality of sub-frames that are selectively combined to display gradations; and each of the sub-frames may at least include an addressing period and a sustain period. The panel may be a three-electrode surface-discharge alternating-current plasma display panel having third electrodes that run in parallel with the second electrodes and applying an alternating voltage to the second and third electrodes to repeat a sustain discharge.

Further, according to the present invention, there is provided a display having a panel, and first and second electrodes; the first and second electrodes defining a matrix of cells on the panel; the second electrodes, which correspond to lines of the cells, being scanned to select cell lines one by one; the first electrodes being driven to set display data for a selected one of the cell lines, wherein the display comprises a sequence setting unit for optionally setting a sequence of scanning the second electrodes.

The display may further comprise a difference detection unit for detecting differences between display data set for the cell lines so that the second electrodes are scanned in a sequence to minimize the differences. The display may further comprise a difference detection unit for detecting differences between display data set for the cell lines; and an upper limit setting unit for setting an upper limit so that the second electrodes are scanned in a sequence to suppress the differences to below the upper limit. The sequence setting unit may divide the second electrodes into blocks and set a sequence of scanning the second electrodes in each of the blocks.

The first electrodes may be addressing electrodes, and the second electrodes may be scan electrodes. The display may further comprise an address driver for driving the addressing electrodes; a current/power detection unit for detecting a current or power value of the address driver; and a sequence changing unit for changing a sequence of scanning the second electrodes to minimize the current or power value.

The display may further comprise a current/power evaluation unit for evaluating a current or power value of the address driver according to display data set for the cell lines so that the second electrodes are scanned in a sequence to minimize the current or power value. The display may further comprise a reference value setting unit for setting a reference value so that the second electrodes are scanned in a sequence to suppress the current or power value to below the reference value. The display may further comprise a current/power evaluation unit for evaluating a current or power value of the address driver according to display data set for the cell lines; and a reference value setting unit for setting a reference value so that the second electrodes are scanned in a sequence to suppress the current or power value to below the reference value. The display may further comprise a current/power evaluation unit for evaluating a current or power value of the address driver beforehand according to display data set for the cell lines; and a reference value setting unit for setting a reference value so that the second electrodes are scanned in a sequence to suppress the current or power value to below the reference value.

The display may further comprise a display data supplying unit for supplying display data line by line to the first electrodes according to the determined sequence of scanning the second electrodes. The display may be a plasma display; a frame of display data may be divided into a plurality of sub-frames that are selectively combined to display gradations; and each of the sub-frames may at least include an addressing period and a sustain period. The panel may be a three-electrode surface-discharge alternating-current plasma display panel having third electrodes that run in parallel with the second electrodes and applying an alternating voltage to the second and third electrodes to repeat a sustain discharge.

According to the present invention, there is also provided a method of driving a display having a panel, and addressing and scan electrodes, the addressing and scan electrodes defining a matrix of cells on the panel; the scan electrodes, which correspond to lines of the cells, being scanned to select the cell lines one by one; the addressing electrodes being driven to set display data for a selected one of the cell lines, wherein the method comprises the steps of setting sequences of scanning the scan electrodes; detecting a current or power value of an address driver for driving the addressing electrodes; and selecting one of the sequences in accordance with the detected current or power value.

The sequences may be set based on powers of two.

Further, according to the present invention, there is also provided a method of driving a display having a panel, and addressing and scan electrodes, the addressing and scan electrodes defining a matrix of cells on the panel; the scan electrodes, which correspond to lines of the cells, being scanned to select the cell lines one by one; the addressing electrodes being driven to set display data for a selected one of the cell lines, wherein the method comprises the steps of detecting a current or power value of an address driver for driving the addressing electrodes; and optionally setting a sequence of scanning the scan electrodes in accordance with the detected current or power value.

The method may further comprise the steps of dividing the scan electrodes into blocks; and setting a sequence of scanning the scan electrodes in each of the blocks.

BRIEF DESCRIPTION OF THE DRAWINGS

The present invention will be more clearly understood from the description of the preferred embodiments as set forth below with reference to the accompanying drawings, wherein:

FIGS. 12A to 12C show changes occurring in electrodes when displaying a pattern;

FIGS. 13A to 13C show changes occurring in electrodes when displaying another pattern;

FIGS. 14 to 16 show changes occurring in electrodes with respect to different patterns;

DESCRIPTION OF THE PREFERRED EMBODIMENTS

Figure 1:
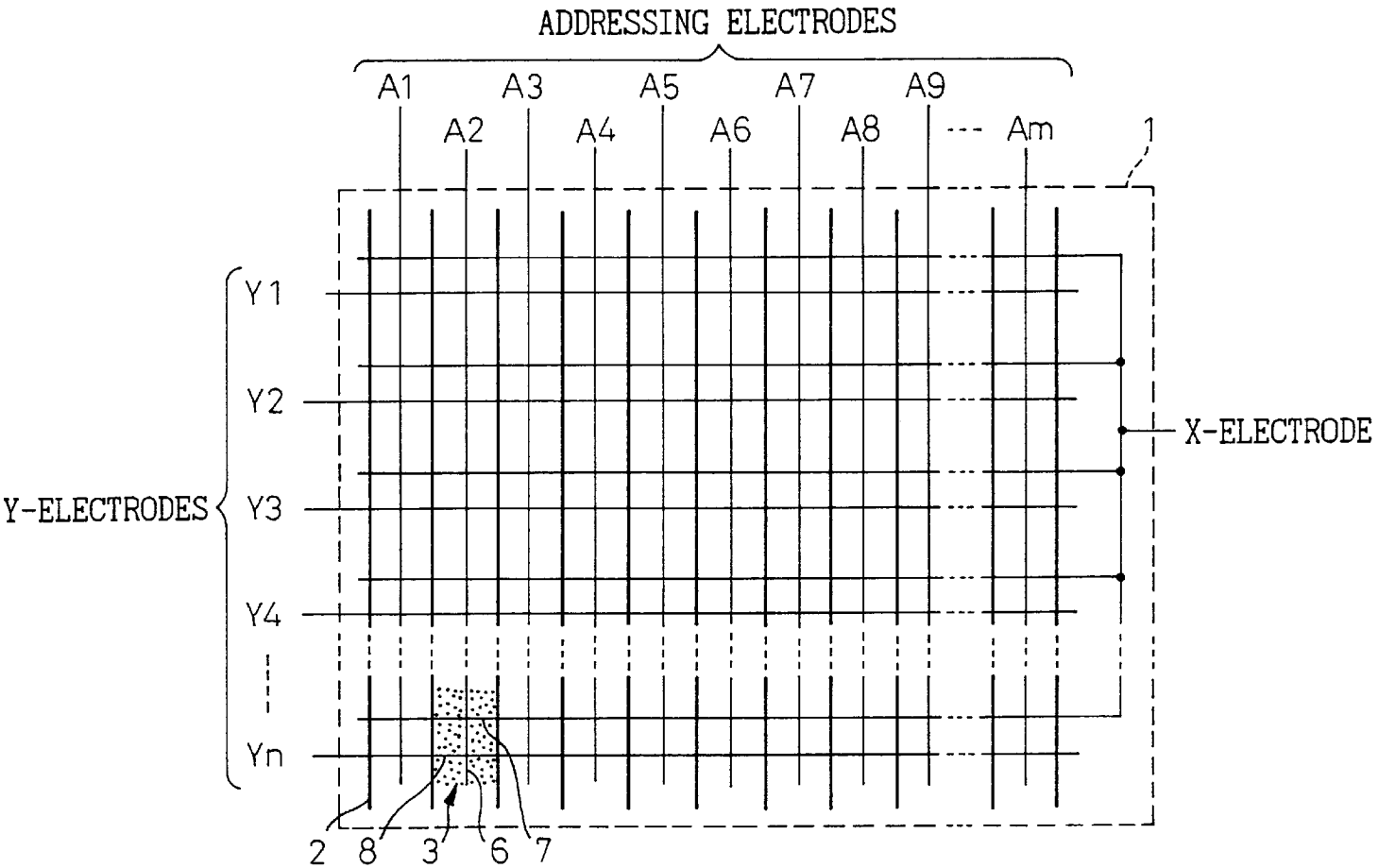
Fig.1 (PRIOR ART)
FIG. 1 shows a 3-electrode, surface-discharge AC PDP according to a prior art.

For a better understanding of the preferred embodiments of the present invention, the problems of the prior art will be explained.

There are known flat displays that employ PDPs (plasma display panels), EL (electroluminescence) elements, LCDs (liquid-crystal displays), VFDs (vacuum fluorescent displays), and LEDs (light emitting diodes). The present invention is applicable to any of these displays. Hereafter, the present invention is explained in connection with plasma displays, in particular, three-electrode surface-discharge alternating-current plasma displays (3-electrode, surface-discharge AC plasma displays).

An AC plasma display has two types of sustain electrodes, i.e., X- and Y-electrodes to which pulses are alternately applied to repeatedly discharge the electrodes and emit light therefrom. One period of discharge lasts for one to several microseconds after the application of a pulse. The discharge produces positively charged ions and negatively charged electrons. The ions accumulate on an insulation layer over an electrode to which a negative voltage is applied, and the electrons accumulate on the insulation layer over an electrode to which a positive voltage is applied. These accumulated ions and electrons are generally called "wall charge."

To make a target cell of the display emit light, a write pulse of high voltage is applied thereto. The write pulse causes a discharge to accumulate as wall charge in the cell. A sustain pulse whose polarity is opposite to that of the write pulse and whose voltage is lower than that of the write pulse is applied to the cell. The sustain pulse causes a discharge to increase the wall charge. This increases a voltage with respect to a discharge space in the cell above a discharge threshold, to start a discharge in the cell. Once a cell of the display accumulates wall charge due to a write discharge, the cell repeats a discharge whenever sustain pulses of opposite polarities are alternately applied thereto. This is called a memory effect or a memory function of the cell. AC PDPs use the memory effect to display information thereon.

There are 2-electrode AC PDPs and 3-electrode AC PDPs. The 2-electrode AC PDPs employ two electrodes to carry out addressing discharge and sustain discharge in each cell. The 3-electrode AC PDPs additionally employ electrodes of a third type to carry out addressing discharge in each cell. Color PDPs for displaying gradations cause discharge in cells to produce ultraviolet rays that excite phosphor contained in the cells. The phosphor is vulnerable to the impact of positively charged ions that are produced when the cells are discharged. The 2-electrode AC PDPs have a structure to make ions directly hit the phosphor, to shorten the service life of the phosphor.

To avoid this, the 3-electrode AC PDPs are usually used for color displays. There are two types of 3-electrode AC PDPS. One type arranges two types of sustain electrodes, i.e., X- and Y-electrodes as well as electrodes of a third type on the same substrate. The other type arranges X- and Y-electrodes on a substrate and third electrodes on an opposite substrate. The PDPs that form the three types of electrodes on the same substrate are classified into two categories. One category forms the third electrodes on the sustain electrodes, and the other forms the third electrodes under the sustain electrodes. There are transmission PDPs that make phosphors emit and transmit visible light toward viewers, and there are reflection PDPs that make phosphors emit and reflect visible light toward viewers. Cells of the PDPs are spatially isolated from one another by barriers. Some PDPs surround every cell with barriers so that the cells are completely isolated from one another. Some PDPs form barriers along opposite edges of each cell and isolate the other opposite edges by proper electrode gaps.

Each example mentioned below relates to a reflection-type PDP display having two types of sustain electrodes on a substrate, addressing electrodes on an opposite substrate, and barriers along the addressing electrodes orthogonally to the sustain electrodes. Each sustain electrode is partly formed with a transparent electrode. The present invention is also applicable to other types of PDP displays, EL displays, LCDs, VFDs, LED displays, etc.

Figure 2:
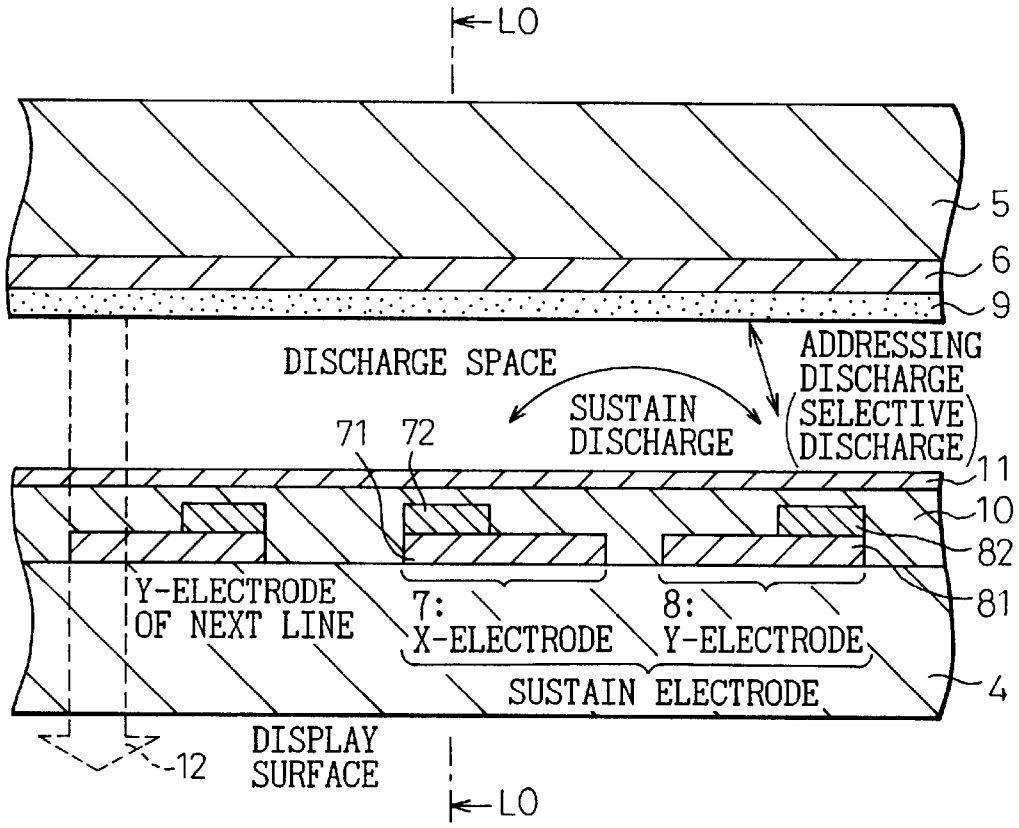
Fig. 2 (PRIOR ART)
FIG. 2 is a sectional view taken along an addressing electrode showing the structure of a cell of the PDP of FIG. 1.
Figure 3:
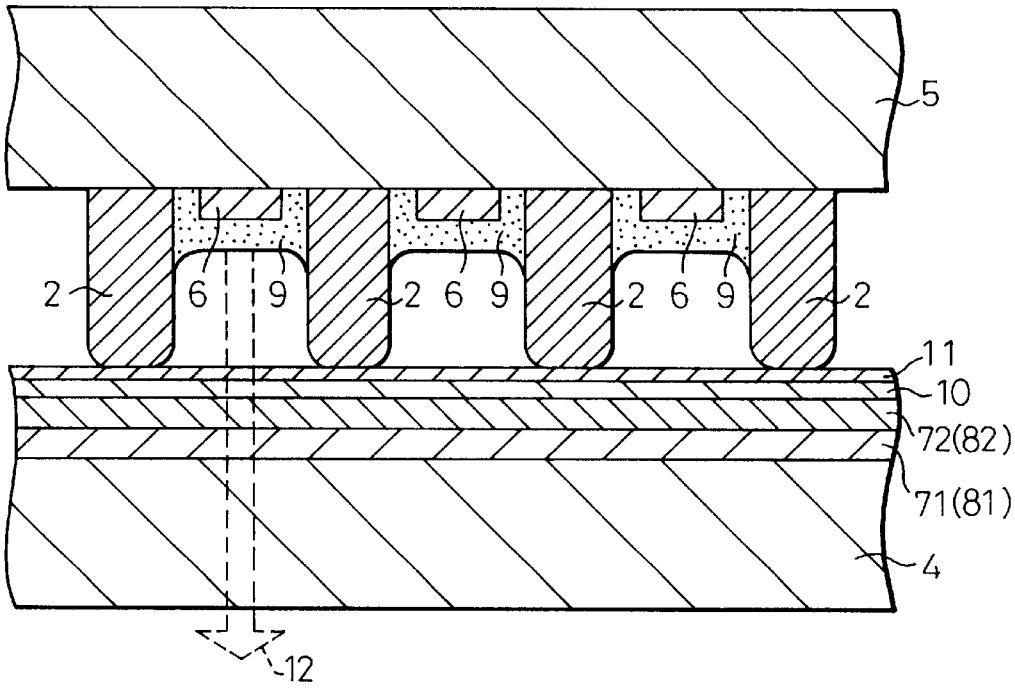
Fig. 3 (PRIOR ART)
FIG. 3 is a sectional view taken along a sustain electrode showing the structure of the cell of FIG. 2.

The prior art will be explained in more detail. FIG. 1 shows a 3-electrode, surface-discharge AC PDP according to the prior art. FIG. 2 is a sectional view taken along an addressing electrode showing one light emitting cell of the PDP of FIG. 1. FIG. 3 is a sectional view taken along a line L0 of FIG. 2, showing the cell of FIG. 2.

The PDP 1 includes barriers 2, the cells 3 for emitting light, a front substrate 4 made of glass, a rear substrate 5 made of glass, addressing electrodes 6, X-electrodes 7, Y-electrodes 8, phosphor 9, a dielectric layer 10, and a protective film 11 made of MgO.

The PDP 1 is basically structured with the substrates 4 and 5. The X-electrodes 7 and Y-electrodes 8 (Y1 to Yn) run in parallel with one another and are formed on the front substrate 4. The front substrate 4 faces the rear substrate 5 on which the addressing electrodes 6 (A1 to Am) are formed orthogonally to the X- and Y-electrodes. Each of the X-electrodes 7 is made of a transparent electrode 71 and a bus electrode 72. Each of the Y-electrodes 8 is made of a transparent electrode 81 and a bus electrode 82. The X- and Y-electrodes serve as sustain electrodes to which an AC voltage is applied to trigger sustain discharge.

The phosphor 9 produces a reflected beam 12. To transmit the reflected beam 12, the transparent electrodes 71 and 81 are made of, for example, ITO whose main component is an indium oxide that is transparent. The bus electrodes 72 and 82 are made of low-resistance metal such as Cr (chrome) and Cu (copper) to prevent a voltage drop due to electrode resistance. The transparent electrodes 71 and 81 and bus electrodes 72 and 82 are covered with the dielectric layer 10 made of, for example, glass to insulate the electrodes. The dielectric layer 10 is covered with the protective film 11 made of MgO (magnesium oxide).

The addressing electrodes 6 are formed on the rear substrate 5 that faces the front substrate 4. The addressing electrodes 6 are orthogonal to the sustain electrodes 7 and 8. The barrier 2 is formed between the adjacent addressing electrodes 6. The addressing electrode 6 between the adjacent barriers 2 is covered with the phosphor 9 having a light emitting characteristic of red, green, or blue.

The ridges of the barriers 2 are attached to the protective film 11, and a discharge gas is sealed between the substrates 4 and 5, to complete the cells 3 of the PDP 1. The cells 3 are bordered with the barriers 2 and are positioned at intersections of the sustain electrodes 7 and 8 and the addressing electrodes 6. Discharge in the cell 3 is mainly caused by the sustain electrodes 7 and 8. A given cell is selected by a discharge caused by the corresponding addressing electrode 6 and Y-electrode 8.

A discharge space in each cell is separated by the barriers 2 so that the cell may discretely cause discharge. The discharge produces ultraviolet rays, which make the phosphor 9 emit a beam to produce the reflection beam 12. The cells 3 are arranged in an "m×n" matrix to form the PDP 1. The addressing electrodes 6 range from A1 to Am, and Y-electrodes 8 from Y1 to Yn. The X-electrodes 7 are commonly connected together.

Figure 4:
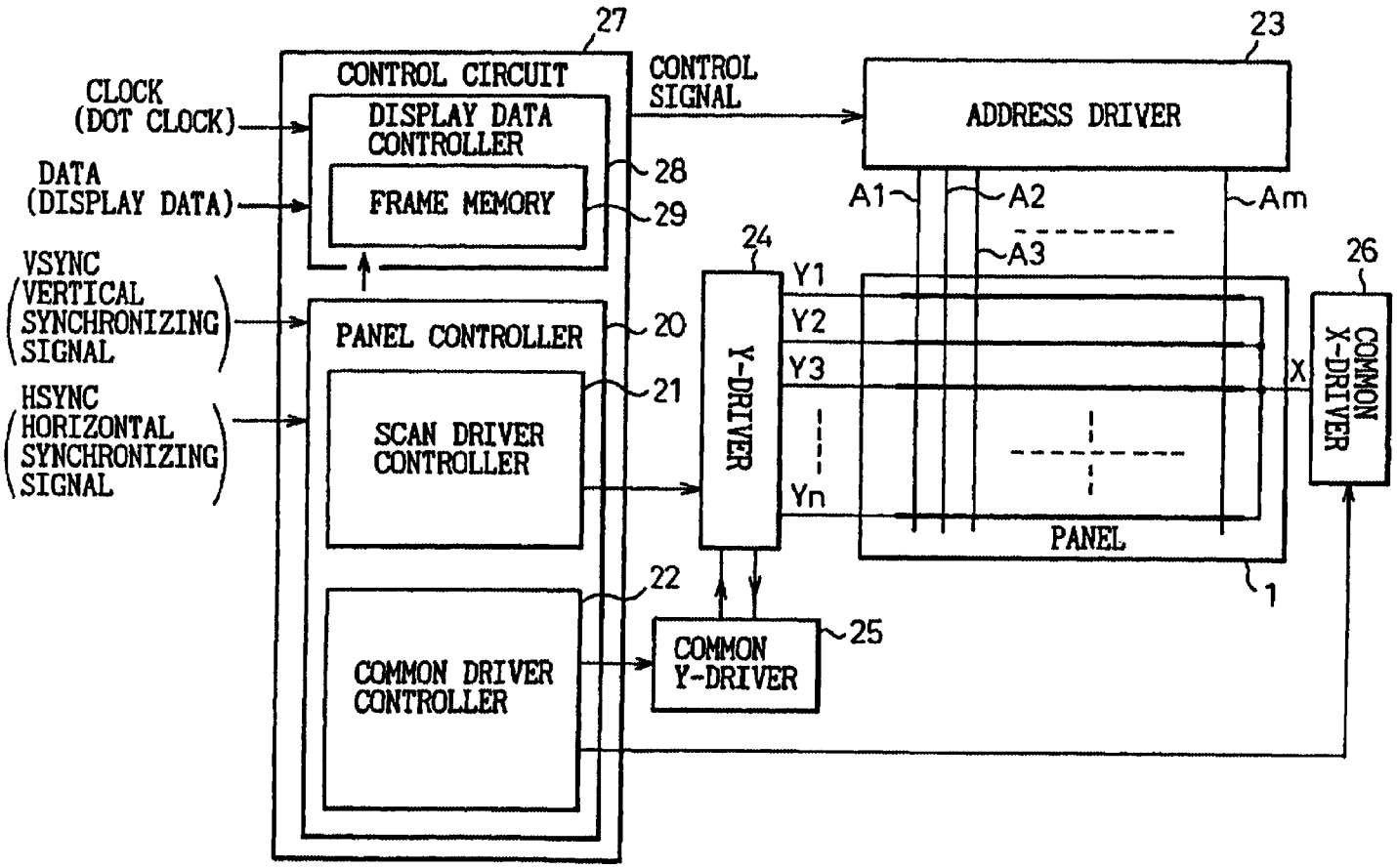
PRIOR ART Fig. 4
FIG. 4 is a block diagram showing a display employing the PDP of FIG. 1.

FIG. 4 is a block diagram showing a PDP display employing the PDP 1 of FIG. 1. The PDP display has peripheral circuits for driving the PDP 1.

The display includes a control circuit 27, a display data controller 28, a frame memory 29, a panel controller 20, a scan driver controller 21, a common driver controller 22, an address driver 23, a Y-driver 24, a common Y-driver 25, and a common X-driver 26.

The display employs a dot clock signal CLOCK, display data DATA (for example, 8-bit display data for each of three primary colors to realize 256 gradations), a vertical synchronizing signal VSYNC to indicate the start of a frame, and a horizontal synchronizing signal HSYNC to indicate the start of a line.

The control circuit 27 has the display data controller 28 and panel controller 20. The display data controller 28 stores display data in the frame memory 29 and provides the address driver 23 with the display data and control signals including a transfer clock signal according to the driving timing of the PDP 1. The panel controller 20 determines the timing of a high-voltage waveform applied to the PDP 1 and has the scan driver controller 21 and common driver controller 22.

The addressing electrodes A1 to Am are individually connected to the address driver 23, which applies addressing pulses to the addressing electrodes to cause addressing discharge. The Y-electrodes Y1 to Yn are individually connected to the Y-driver 24, which is connected to the common Y-driver 25. The Y-driver 24 generates pulses to select a line during an addressing period. The common Y-driver 25 generates sustain pulses, which are applied to the Y-electrodes Y1 to Yn through the Y-driver 24. The X-electrodes 7 are commonly connected to cover all display lines of the PDP 1 and are controlled by the common X-driver 26 that is connected to the common driver controller 22. The common X-driver 26 generates write pulses and sustain pulses. These drivers are controlled by the control circuit 27, which is controlled by external signals including VSYNC, HSYNC, CLOCK, and DATA.

Figure 5:
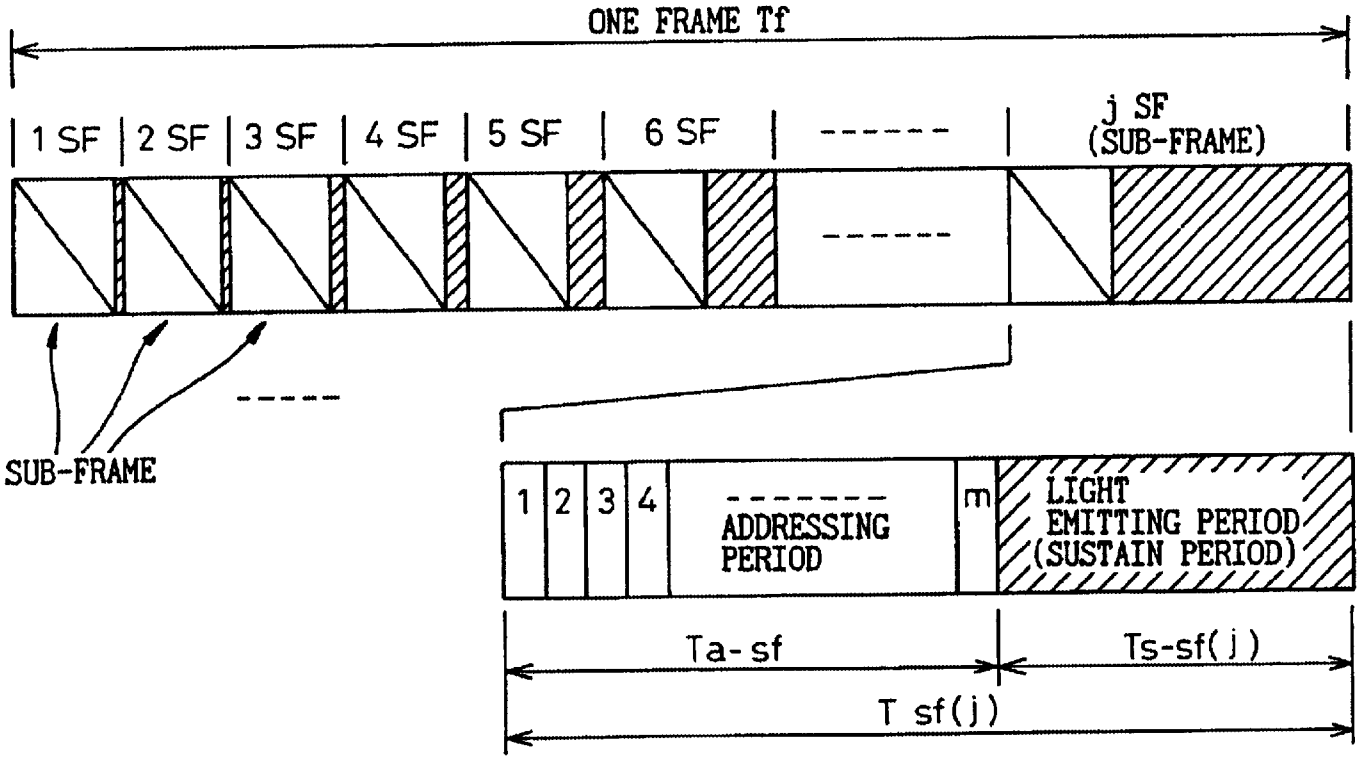
PRIOR ART Fig.5
FIG. 5 is a timing chart showing a gradation control technique using sub-frames carried out on the PDP display of FIG. 4.
Figure 6:
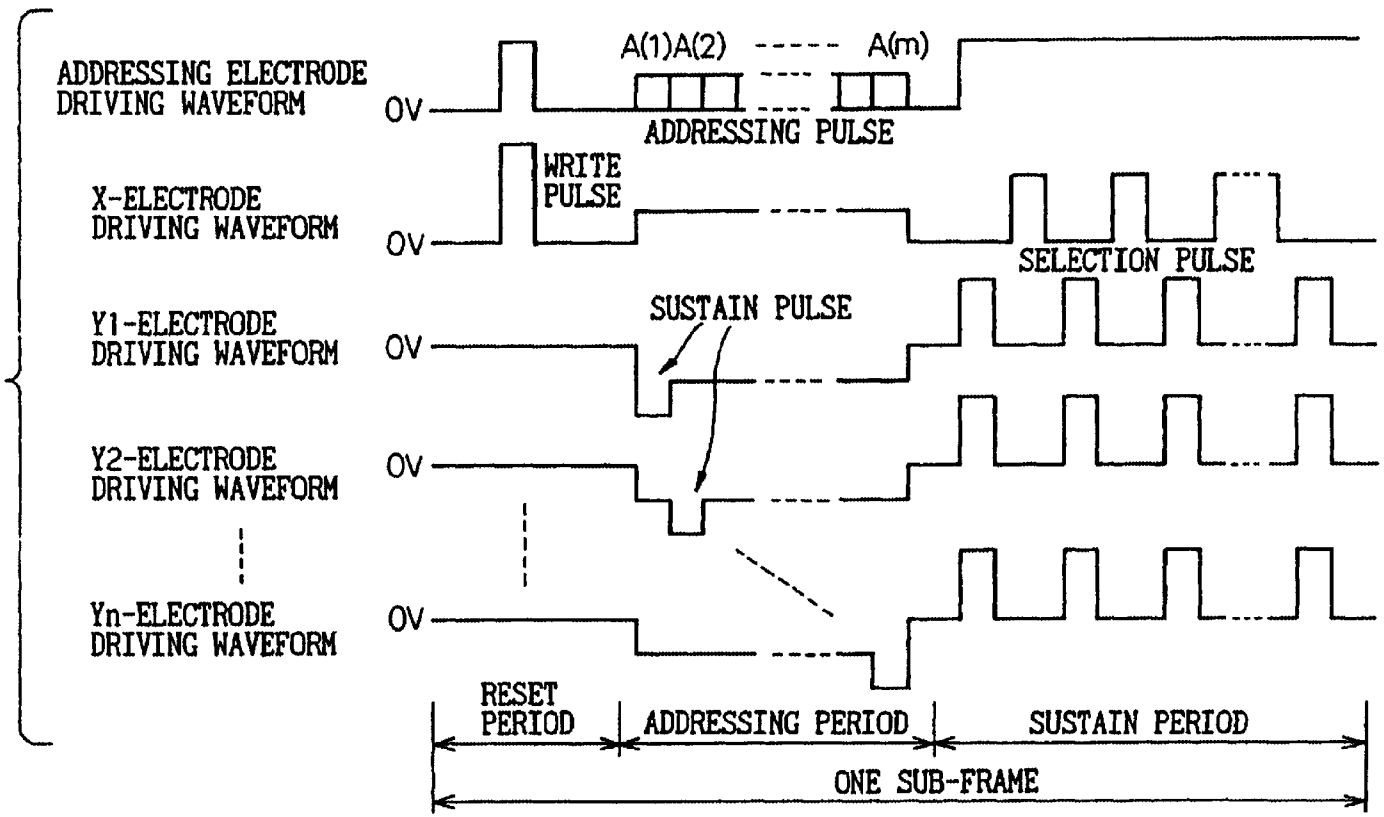
PRIOR ART Fig.6
FIG. 6 shows waveforms for driving the PDP display of FIG. 4.

FIG. 5 is a timing chart showing a gradation control technique using sub-frames carried out on the PDP display of FIG. 4, and FIG. 6 shows waveforms for driving the PDP display of FIG. 4.

To display gradations on the PDP display of FIG. 4, the technique of FIG. 5 divides a frame Tf into sub-frames 1SF to jSF (for example, j=8) to which display data bits are assigned, respectively. The sub-frames 1SF to 8SF have respective sustain periods whose lengths differ from one another to display gradation levels in combination. If each piece of display data consists of "j" bits to realize $2^j$ gradation levels, every frame is divided into j sub-frames having sustain periods Ts-sf(j) of the ratio of 1:2:4:8: . . . : $2^{j-1}$. The sub-frames have each an identical addressing period Ta-sf.

Each sub-frame consists of a reset period, an addressing period, and a sustain period. The reset period sets all of the Y-electrodes Y1 to Yn to 0 V and applies write pulses to all of the addressing electrodes A1 to Am and X-electrodes 7. As a result, every cell causes a discharge and neutralizes itself. This is a self-erase discharge.

The addressing period turns on and off the cells line by line according to display data. During the addressing period, any cell that must be turned on accumulates a priming charge. The sustain period applies pulses alternately to the X- and Y-electrodes, to cause sustain discharge and display an image in the corresponding sub-frame.

In the addressing period, the address driver 23 applies addressing pulses A(1) to A(m) according to display data to the addressing electrodes A1 to Am. At the same time, the Y-driver 24 applies selection pulses to the Y-electrodes Y1 to Yn. During the sustain period, the common Y-driver 25 applies sustain pulses to the Y-electrodes Y1 to Yn. The X-electrodes 7 are commonly connected to the common X-driver 26, which applies common pulses to the X-electrodes.

The number of pulses applied during the sustain period determines a gradation level. Namely, the sub-frames 1SF to jSF are selectively turned on to display one of the gradation levels 0 to $2^j$-1.

Figure 7:
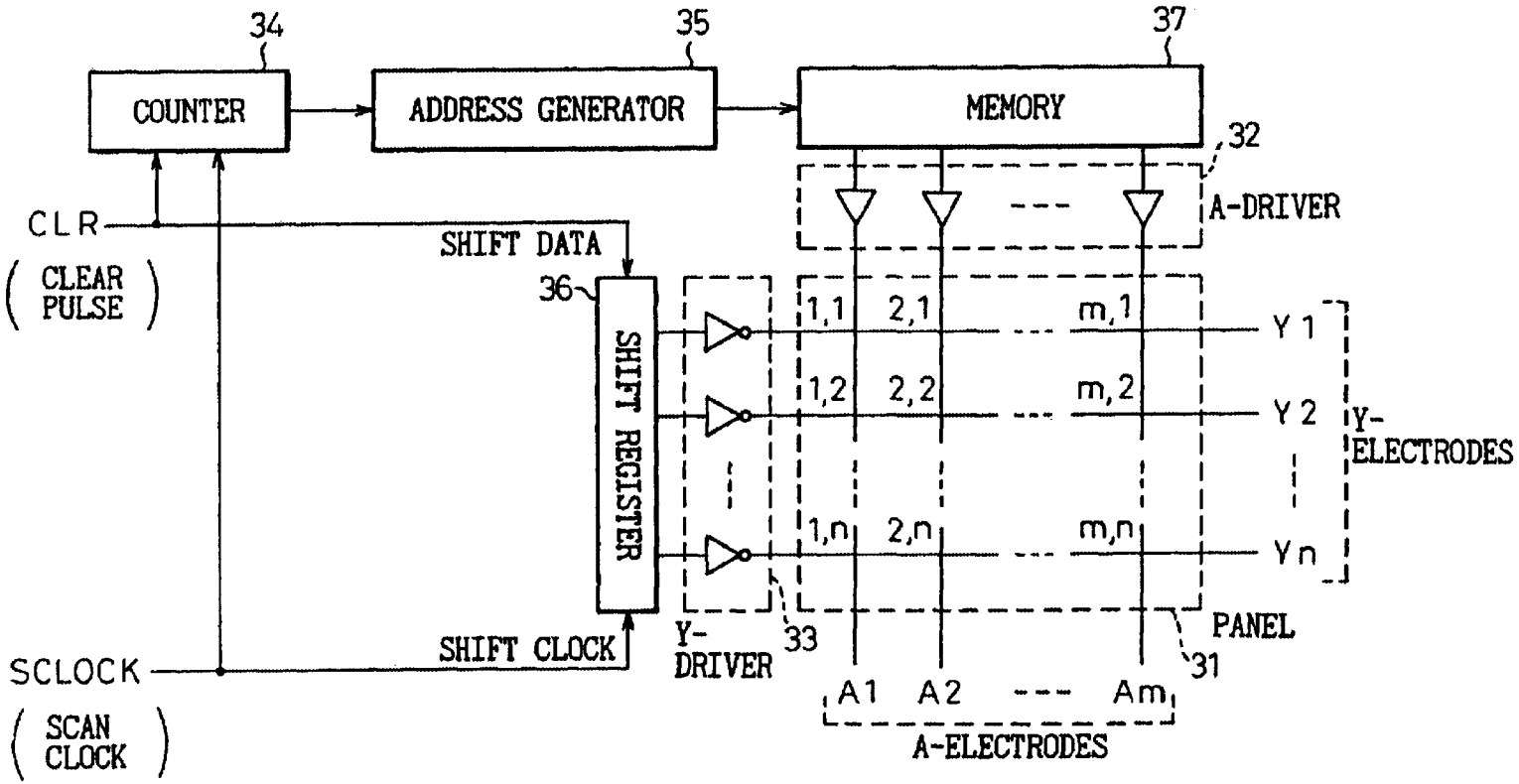
PRIOR ART Fig.7
FIG. 7 is a block diagram showing a display according to a prior art.
Figure 8:
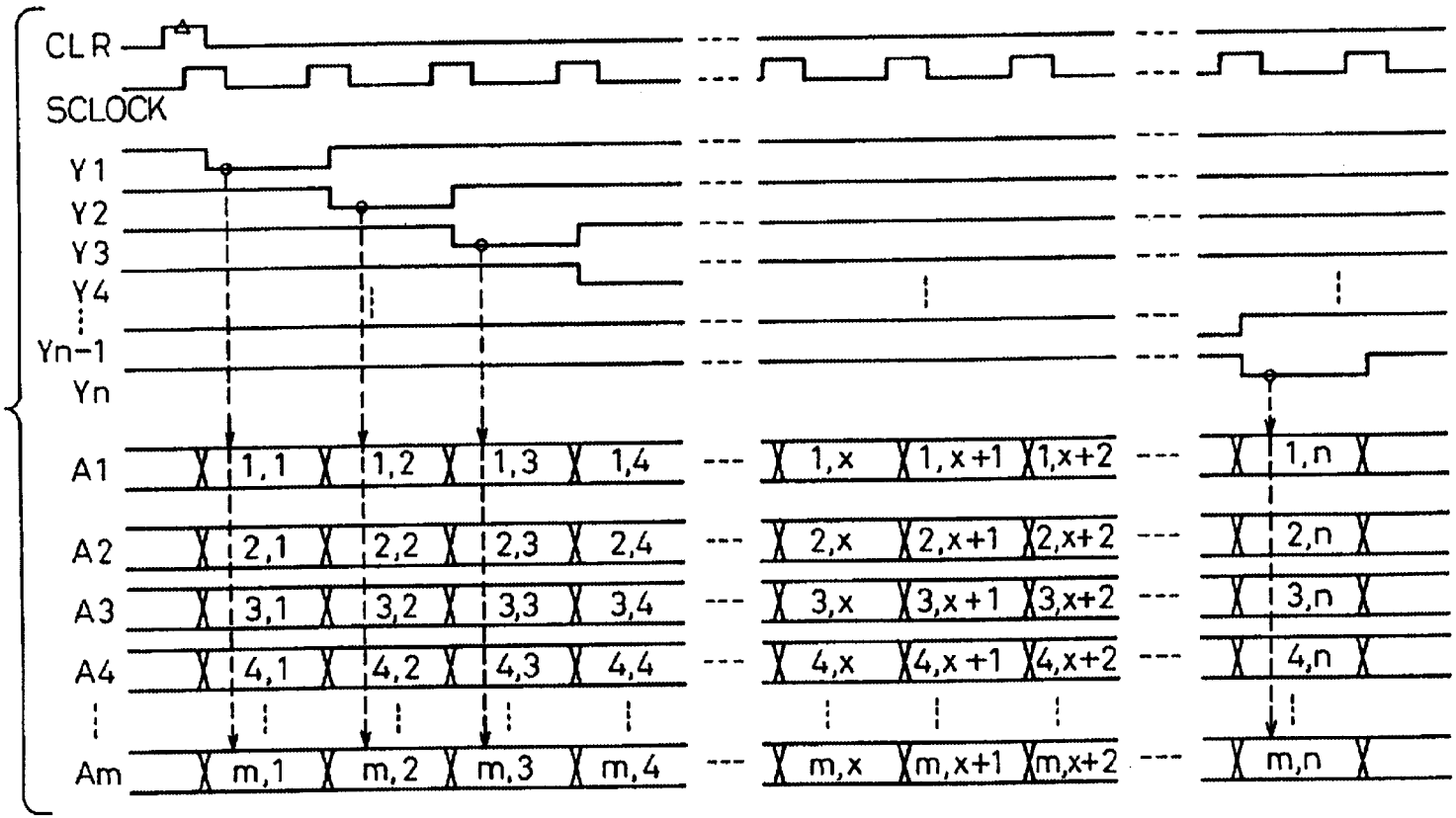
PRIOR ART Fig.8
FIG. 8 is a timing chart showing the operation of the display of FIG. 7.

FIG. 7 is a block diagram showing a display according to the prior art, and FIG. 8 is a timing chart showing the operation of the display of FIG. 7.

The display has a panel 31, an address driver (A-driver) 32, a Y-driver 33, a line counter 34, an address generator 35, a shift register 36, and a memory 37. The A-driver 32, Y-driver 33, and memory 37 correspond to the address driver 23, Y-driver 24, and frame memory 29 of FIG. 4. The shift register 36 is installed in the scan driver controller 21, and the counter 34 and address generator 35 are installed in the display data controller 28 of FIG. 4. The memory 37 may consist of two frame memories so that data is written into one of them while data is transferred from the other to the panel 31 with the use of the sub-frame technique. In FIG. 7, a frame of display data is present in the memory 37 and is read therefrom into the panel 31.

The shift register 36 is used to scan the panel 31 line by line according to shift data and a shift clock signal. The address generator 35 converts the output of the counter 34 into an address of the memory 37 at which display data for a presently scanned line of the panel 31 is read.

The operation of the display of the prior art of FIG. 7 will be explained with reference to FIG. 8. To write data into the panel 31, the prior art applies a clear pulse CLR at the start of each of the sub-frames 1SF to jSF (FIG. 5). The Y-driver 33 sequentially selects the Y-electrodes Y1 to Yn in response to a scan clock signal SCLOCK. Display data for a scanned Y-electrode is supplied from the memory 37 to the A-driver 32, which applies the display data to the addressing electrodes A1 to Am.

More precisely, the counter 34 receives the clear pulse CLR and scan clock signal SCLOCK and makes the address generator 35 specify display data for a scanned Y-electrode.

For example, if the Y-electrode Y1 is scanned, data pieces for cells (1, 1), (2, 1), (3, 1), . . . , and (m, 1) on the Y-electrode Y1 are applied to the addressing electrodes A1 to Am. If the Y-electrode Y2 is scanned, data pieces for cells (1, 2), (2, 2), (3, 2), . . . , and (m, 2) on the Y-electrode Y2 are applied to the addressing electrodes A1 to Am. If the Y-electrode Yn is scanned, data pieces for cells (1, n), (2, n), (3, n), . . . , and (m, n) on the Y-electrode Yn are applied to the addressing electrodes A1 to Am.

In this way, the prior art scans the Y-electrodes only in a sequence of Y1, Y2, Y3, . . . , Yn, and this sequence is never changed.

The A-driver 32 provides display data for a presently scanned line. At this time, the power consumption of the A-driver 32 is the sum of power used to write data and power used to charge and discharge the addressing electrodes A1 to Am.

The resolution of displays, i.e., the number of lines on a screen of displays has been increased to increase electrode-to-electrode capacitance. The power consumption to charge and discharge the electrodes is a large part of the power consumption of the A-driver 32. Therefore, the power required to charge and discharge the electrodes must be reduced to minimize the power consumption.

The power required to charge and discharge electrodes is determined by the capacitance, driving voltage, and driving frequency of the electrodes. Among them, only the driving frequency is controllable. A conventional technique drops the driving frequency by masking display data or by reducing the number of sub-frames in each frame. This technique results in reducing the number of gradation levels to be displayed, thereby deteriorating the quality of images to be displayed.

Next, displays and display driving methods according to preferred embodiments of the present invention will be explained with reference to the drawings.

Figure 9:
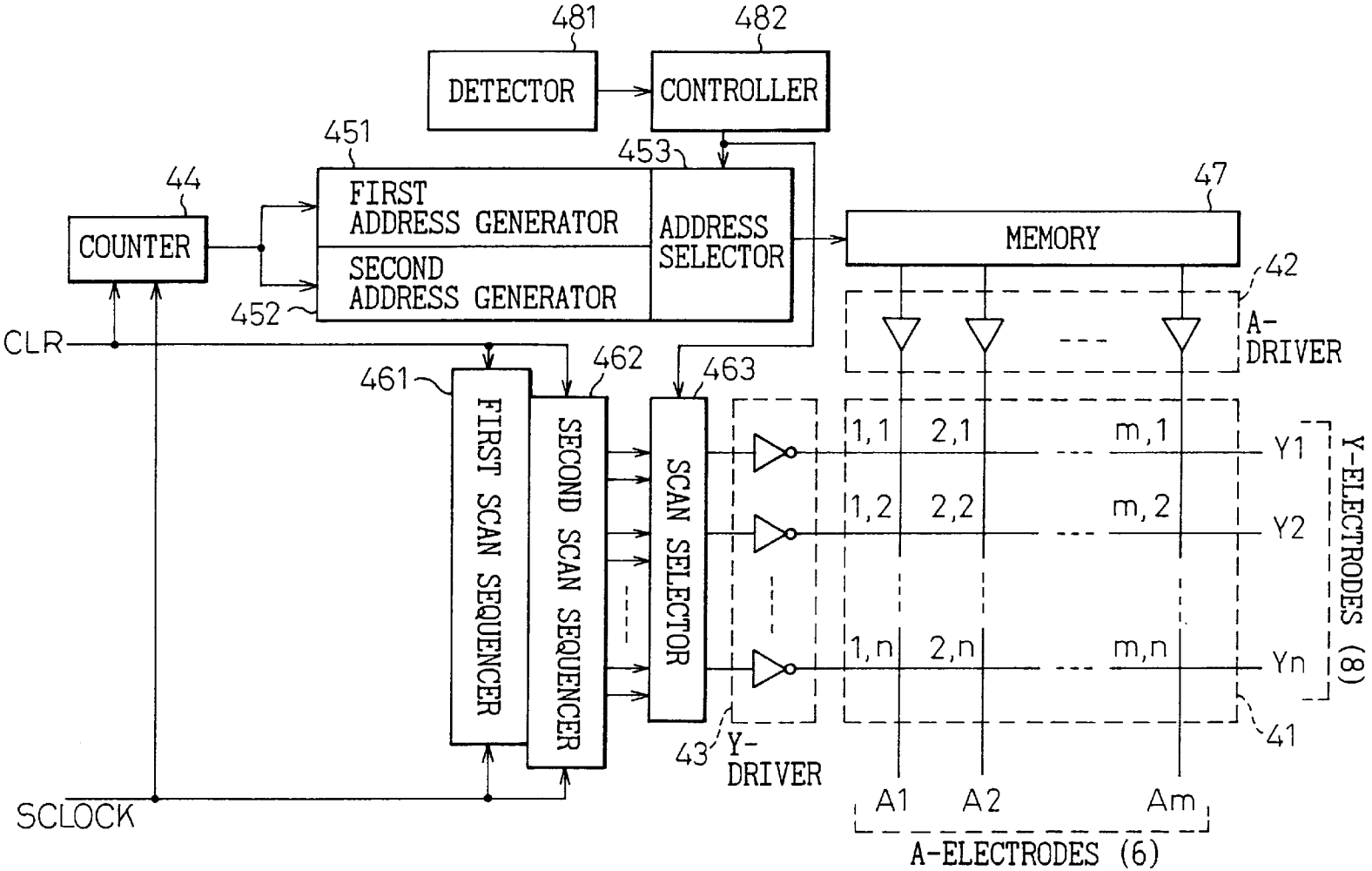
FIG. 9 is a block diagram showing a display according to a first embodiment of the present invention.
Figure 10:
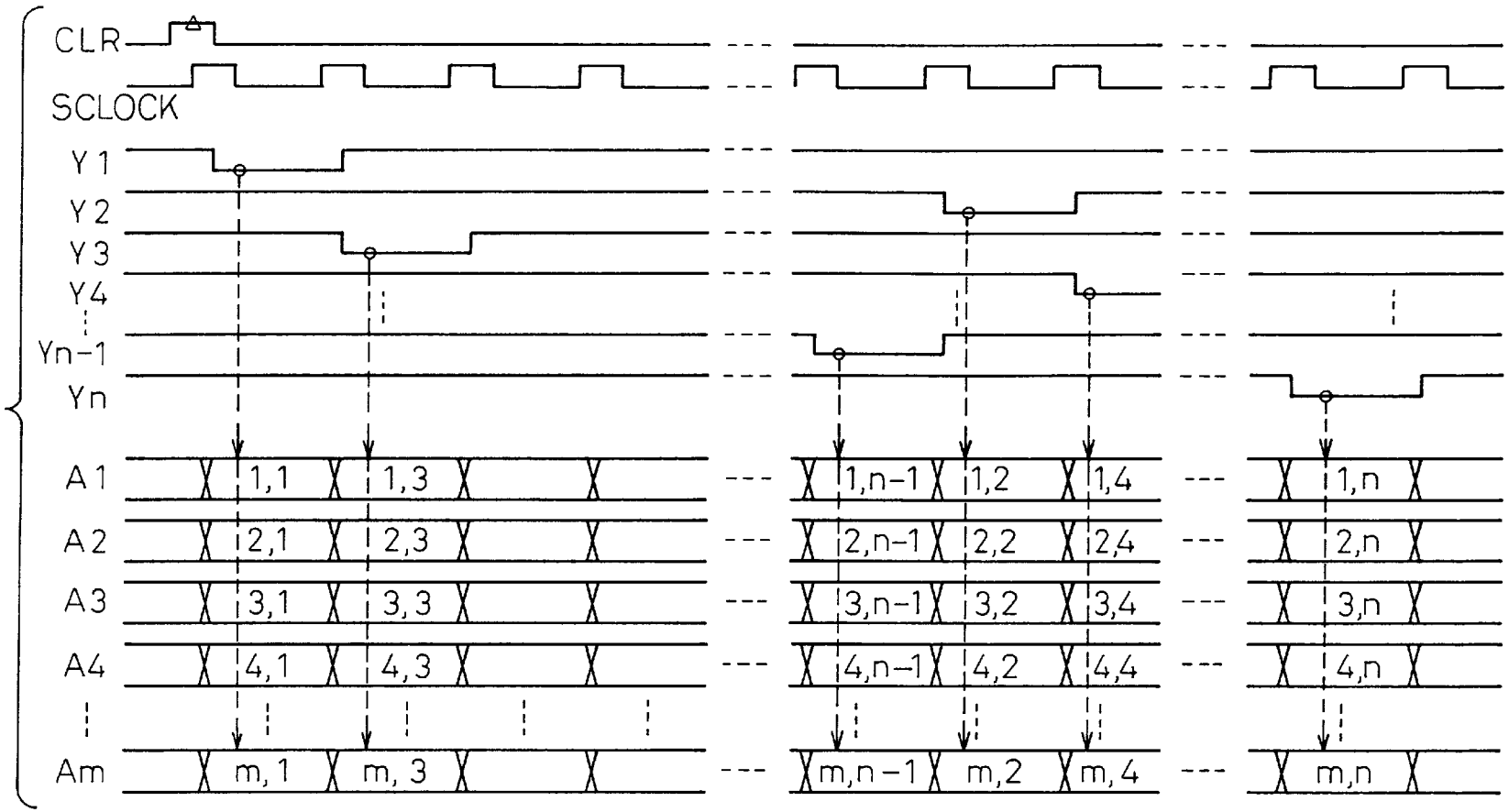
FIG. 10 is a timing chart showing the operation of the display of FIG. 9.

FIG. 9 is a block diagram showing a display according to the first embodiment of the present invention, and FIG. 10 is a timing chart showing the operation of the display.

The display has a panel 41, an address driver (A-driver) 42, a Y-driver 43, a counter 44, a first address generator 451, a second address generator 452, an address selector 453, a first scan sequencer 461, a second scan sequencer 462, a scan selector 463, a memory 47, a detector 481, and a controller 482.

The A-driver 42, Y-driver 43, and memory 47 correspond to the address driver 23, Y-driver 24, and frame memory 29 of FIG. 4. The first scan sequencer 461, second scan sequencer 462, and scan selector 463 are installed in the scan driver controller 21 of FIG. 4. The counter 44, first address generator 451, second address generator 452, address selector 453, detector 481, and controller 482 are installed in the display data controller 28 of FIG. 4. Although the display of FIG. 9 has two address generators and two scan sequencers, the numbers of these devices are optional.

The first address generator 451 generates addresses of the memory 47 according to a Y-electrode scan sequence provided by the first scan sequencer 461. The second address generator 452 generates addresses of the memory 47 according to a Y-electrode scan sequence provided by the second scan sequencer 462. The first and second scan sequencers 461 and 462 provide different Y-electrode scan sequences, i.e., a different power consumption or a different charging and discharging power of the A-driver 42.

The detector 481 detects the current or power consumption of the A-driver 42 according to the outputs of the first and second address generators 451 and 452. A smaller one of the outputs detected by the detector 481 is selected by the address selector 453. The output of one of the first and second scan sequencers 461 and 462 corresponding to the output of the address selector 453 is selected by the scan selector 463. If the detector 481 determines that the output of the first address generator 451 leads to smaller power consumption of the A-driver 42, the address selector 453 selects the output of the first address generator 451, and at the same time, the scan selector 463 selects the output of the first scan sequencer 461.

The relationship between data read out of the memory 47 according to selection made by the address selector 453 and the Y-electrodes scanned according to selection made by the scan selector 463 is the same as that of the prior art, except order of scanning the Y-electrodes.

An example of a data write operation to the panel 41 according to the first embodiment will be explained with reference to FIG. 10. At the start of each sub-frame (FIG. 5), a clear pulse CLR is applied. The Y-driver 43 scans the Y-electrodes Y1 to Yn according to the output of the scan sequencer selected by the scan selector 463. At the same time, the address selector 453 selects the address generator that corresponds to the selected scan sequencer and supplies the output of the selected address generator to the memory 47. As a result, the A-driver 42 supplies display data corresponding to the scanned Y-electrode to the addressing electrodes A1 to Am.

For example, if the Y-electrodes are scanned in order of Y1, Y3, . . . , and Yn-1, and then, Y2, Y4, . . . , and Yn, display data is supplied to the addressing electrodes Al to Am in order of (1, 1) to (m, 1), (1, 3) to (m, 3), . . . , and (1, n−1) to (m, n−1), and then, (1, 2) to (m, 2), (1, 4) to (m, 4), . . . , and (1, n) to (m, n).

This scan sequence reduces the number of changes which occur in the output of the A-driver 42, thereby reducing the driving frequency of the panel 41, i.e., the power consumption thereof. The first and the following embodiments do not change display data itself and, therefore, maintain the quality of displayed images.

Figure 11:
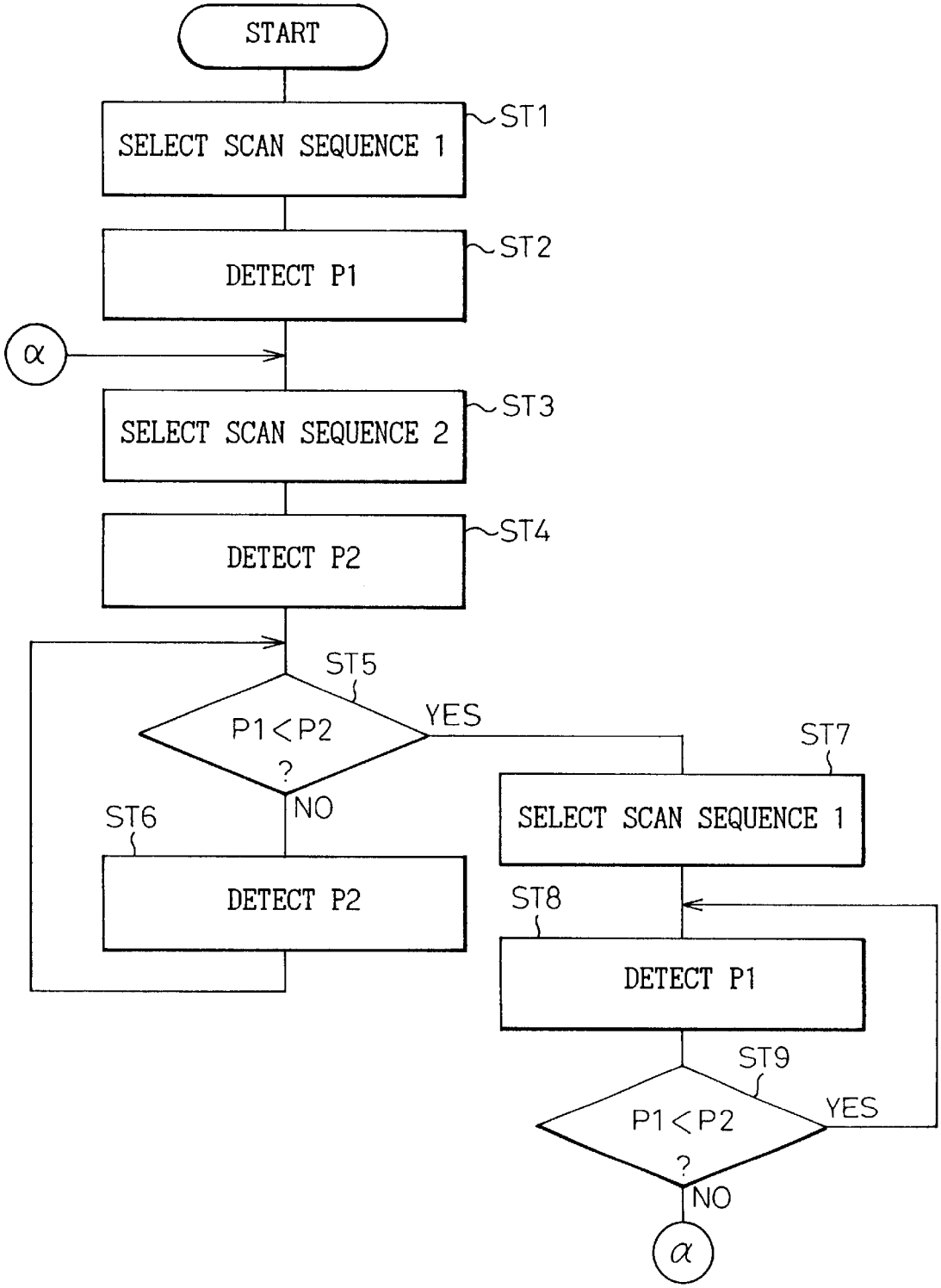
FIG. 11 is a flowchart showing a control sequence of the display of FIG. 9.

FIG. 11 is a flowchart showing a control sequence of the display of FIG. 9.

Step ST1 selects a scan sequence 1 to select the output of the first address generator 451. Step ST2 detects the power consumption "P1" of the A-driver 42, i.e., a current flowing to the A-driver 42 based on the scan sequence 1.

Step ST3 selects a scan sequence 2 to select the output of the second address generator 452. Step ST4 detects the power consumption "P2" of the A-driver 42 based on the scan sequence 2.

Step ST5 checks to see if P1 <P2. If P1 <P2, step ST7 selects the scan sequence 1 of smaller power consumption. Step ST8 detects a new power consumption value P1 based on the scan sequence 1. Step ST9 checks to see if P1 <P2. If P1 <P2, the flow returns to step ST8, and if not, the scan sequence 1 is maintained until P1>=P2.

If P1>=P2 in step ST5, step ST6 detects a new power consumption value P2 based on the scan sequence 2, and step ST5 is repeated. This loop is repeated to maintain the scan sequence 2 until step ST5 determines that P1 <P2.

In this way, the first embodiment detects power consumption values P1 and P2 of the A-driver 42 based on scan sequences 1 and 2, compares the values P1 and P2 with each other, and always selects one of the scan sequences 1 and 2 that provides a lower power consumption value. Although the number of scan sequences is two in the above example, any number of scan sequences are employable for the present invention.

FIGS. 12A to 16 explain changes in electrodes with respect to various patterns to be displayed.

In FIG. 12A, a "4×4" matrix of 16 cells (pixels) displays a checkered pattern with Y-electrodes Y1 to Y4 and addressing electrodes (A-electrodes) A1 to A4.

FIG. 12B shows a scan sequence that scans the Y-electrodes in order of Y1, Y2, Y3, and Y4. In this sequence, the levels of the A-electrodes A1 to A4 change from 0 to 1 and from 1 to 0 as shown in the figure. Namely, they show 12 changes in total with each A-electrode showing three changes.

FIG. 12C shows a scan sequence that scans the Y-electrodes in order of Y1, Y3, Y2, and Y4. In this case, the A-electrodes Al to A4 show four changes in total with each A-electrode showing one change.

When displaying the checkered pattern of FIG. 12A, the scan sequence of FIG. 12C greatly reduces the power consumption of a driver for driving the A-electrodes compared with the scan sequence of FIG. 12B.

FIG. 13A shows another checkered pattern displayed on the same display as that of FIG. 12A.

FIG. 13B shows a scan sequence that scans the Y-electrodes in order of Y1, Y2, Y3, and Y4. In this case, the A-electrodes A1 to A4 show four changes in total with each A-electrode showing one change.

FIG. 13C shows a scan sequence that scans the Y-electrodes in order of Y1, Y3, Y2, and Y4. In this case, the A-electrodes A1 to A4 show 12 changes with each A-electrode showing three changes.

When displaying the checkered pattern of FIG. 13A, the scan sequence of FIG. 13B greatly reduces the power consumption of the driver for driving the A-electrodes compared with the scan sequence of FIG. 13C.

Figure 14:
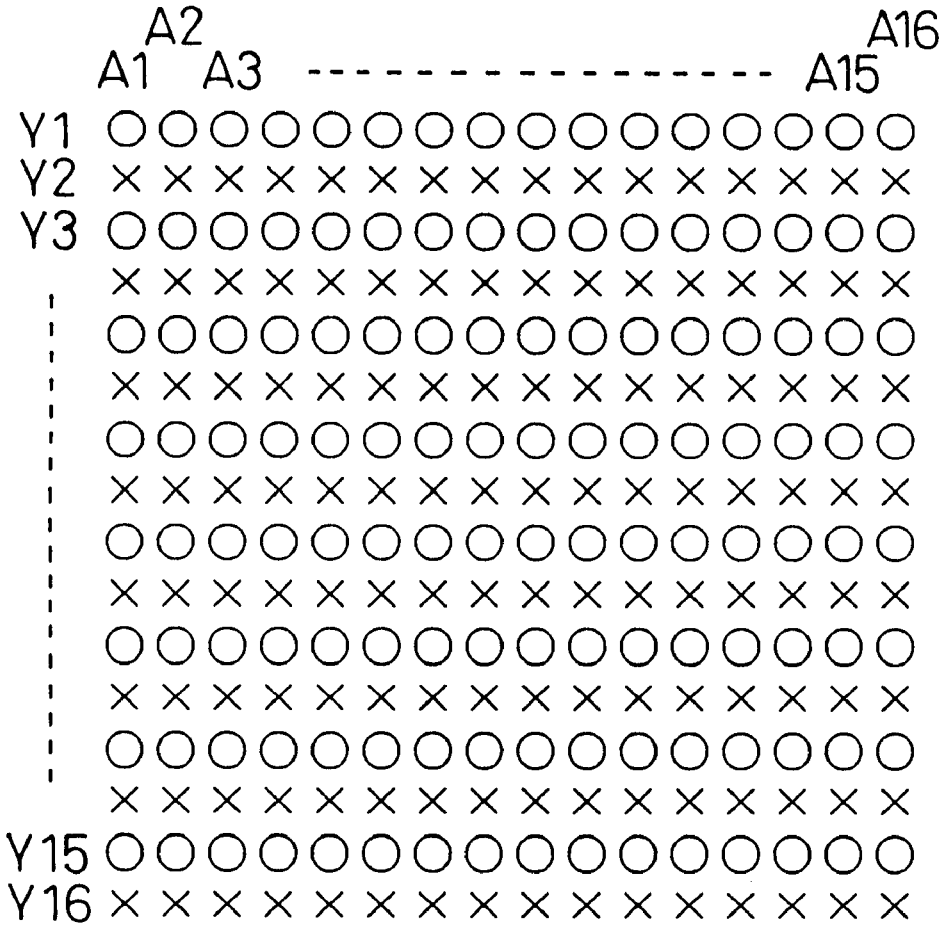

FIG. 14 shows a "16×16" matrix of 256 cells (pixels) having Y-electrodes Y1 to Y16 and A-electrodes A1 to A16. The matrix displays stripes that alternate line by line. A normal scan sequence of Y1, Y2, Y3, Y4, . . . , Y15, and Y16 causes 240 changes in total in the levels of the A-electrodes A1 to A16. An odd-even scan sequence of Y1, Y3, Y5, Y7, . . . , Y15, and then, Y2, Y4, Y6, Y8, . . . , Y14, and Y16 causes 16 changes in total in the levels of the A-addresses Al to A16. Consequently, the odd-even scan sequence greatly reduces the power and current consumption of a driver for driving the A-electrodes.

Figure 15:
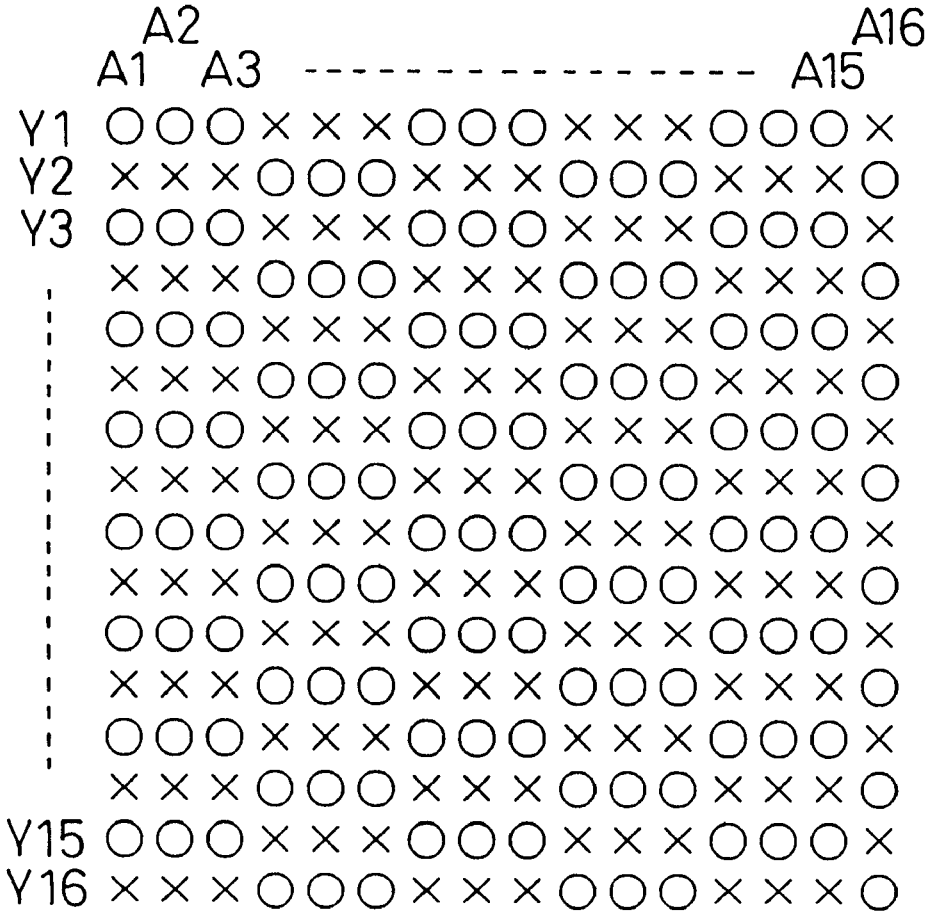

FIG. 15 shows a checkered pattern displayed on the same display as that of FIG. 14. The normal scan sequence mentioned above causes 240 changes in total in the levels of the A-electrodes A1 to A16, and the odd-even scan sequence mentioned above 16 changes. Consequently, the odd-even scan sequence can greatly reduce the power and current consumption of the driver for driving the A-electrodes.

FIG. 16 shows a pattern displayed on the same display as that of FIG. 14. The normal scan sequence mentioned above causes 121 changes in total in the levels of the A-electrodes A1 to A16, and the odd-even scan sequence mentioned above 61 changes. Consequently, the odd-even scan sequence can greatly reduce the power and current consumption of the driver for driving the A-electrodes. In addition to the normal and odd-even scan sequences explained with reference to FIGS. 14 to 16, a variety of scan sequences are possible according to the present invention.

Figure 17:
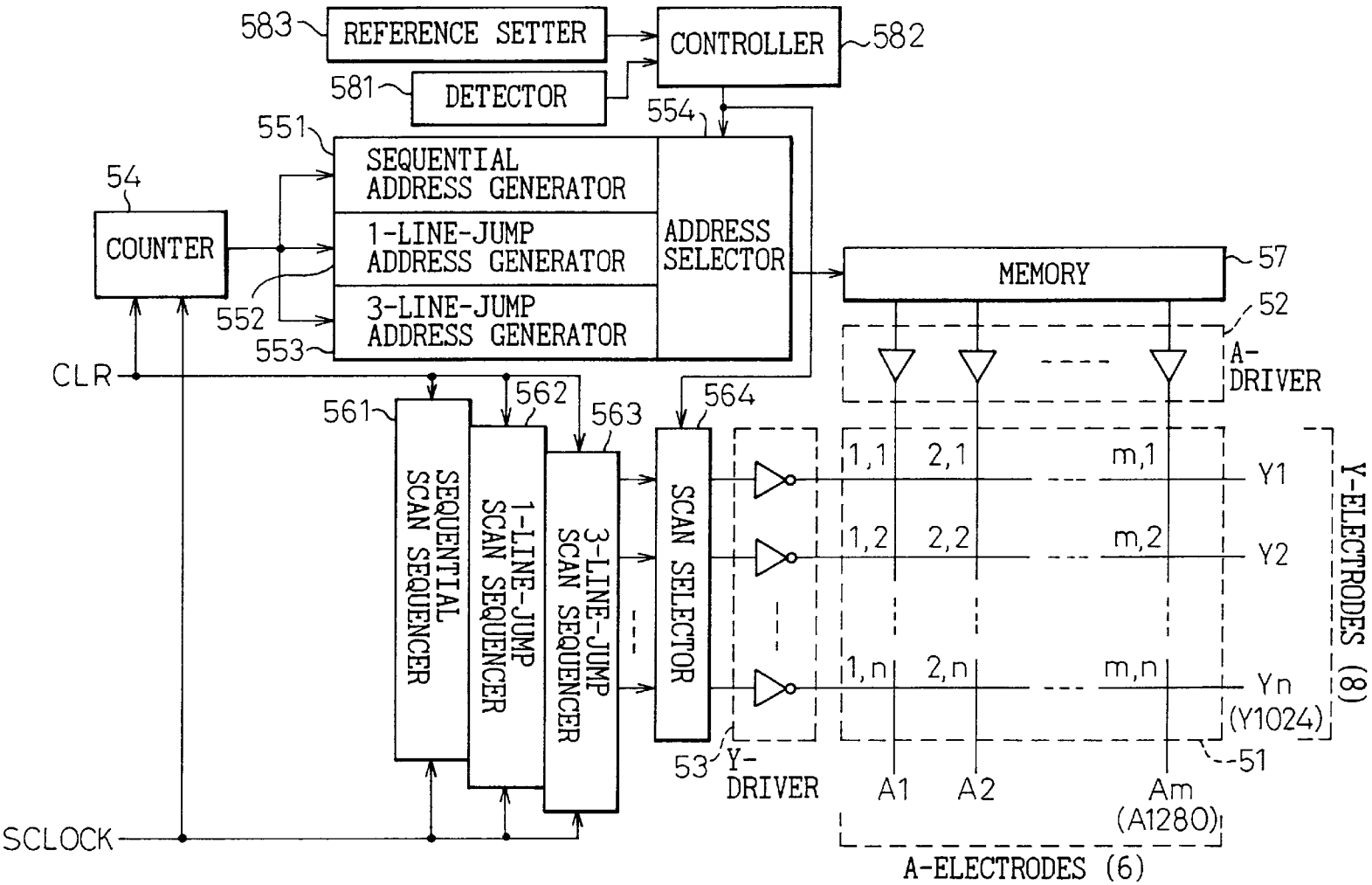
FIG. 17 is a block diagram showing a display according to a second embodiment of the present invention.

FIG. 17 is a block diagram showing a display according to the second embodiment of the present invention. The display has a panel 51, an address driver (A-driver) 52, a Y-driver 53, a counter 54, a sequential address generator 551, a 1-line-jump address generator 552, a 3-line-jump address generator 553, an address selector 554, a sequential scan sequencer 561, a 1-line-jump scan sequencer 562, a 3-line-jump scan sequencer 563, a scan selector 564, a memory 57, a detector 581, a controller 582, and a reference setter 583.

The A-driver 52, Y-driver 53, and memory 57 correspond to the address driver 23, Y-driver 24, and frame memory 29 of FIG. 4. The sequential scan generator 561, 1-line-jump scan sequencer 562, 3-line-jump scan sequencer 563, and scan selector 564 are installed in the scan driver controller 21 of FIG. 4. The counter 54, sequential address generator 551, 1-line-jump address generator 552, 3-line-jump address generator 553, address selector 554, detector 581, controller 582, and reference setter 583 are installed in the display data controller 28 of FIG. 4.

The display of the second embodiment is characterized by the sequential address generator 551, 1-line-jump address generator 552, 3-line-jump address generator 553, sequential scan sequencer 561, 1-line-jump scan sequencer 562, and 3-line-jump scan sequencer 563 that select one of three scan sequences to minimize the current and power consumption of the A-driver 52. Although the second embodiment uses sequential, 1-line-jump, and 3-line-jump scan sequences each of which is a power of 2, the present invention may employ address generators and scan sequencers that realize 7-line-jump, 15-line-jump, or any other sequences. The panel 51 of FIG. 17 has 1024 Y-electrodes Y1 to Y1024 and 1280 addressing electrodes (A-electrodes) A1 to A1280.

The detector 581 detects the current or power consumption of the A-driver 52 in response to the outputs of the sequential address generator 551, 1-line-jump address generator 552, and 3-line-jump address generator 553. The address selector 554 selects one of the outputs of the address generators 551 to 553 that is determined to be the smallest by the detector 581. At the same time, the scan selector 564 selects one of the sequencers 561 to 563 that corresponds to the output selected by the address selector 554.

For example, if the detector 581 determines that the output of the sequential address generator 551 minimizes a current flowing through the A-driver 52, the address selector 554 selects the output of the sequential address generator 551, and the scan selector 564 selects the output of the sequential scan sequencer 561. If the output of the 1-line-jump address generator 552 is determined to minimize a current flowing through the A-driver 52, the address selector 554 selects the output of the 1-line-jump address generator 552, and the scan selector 564 selects the output of the 1-line-jump scan sequencer 562. If the output of the 3-line-jump address generator 553 is determined to minimize a current flowing through the A-driver 52, the address selector 554 selects the output of the 3-line-jump address generator 553, and the scan selector 564 selects the output of the 3-line-jump scan sequencer 563.

The reference setter 583 sets a reference value of a current (power) flowing through the A-driver 52. If an actual current flowing through the A-driver 52 is smaller than the reference value, the present scan sequence is maintained, and if not, the present scan sequence is changed to the output of another scan sequencer that brings the current below the reference value. The reference value is set in consideration of various display patterns so that at least one of the outputs of the scan sequencers 561 to 563 may bring an actual current passing through the A-driver 52 below the reference value.

A sequential scan set by the sequential scan sequencer 561 sequentially scans the Y-electrodes in order of Y1, Y2, Y3, Y4, . . . , Y1023, and Y1024. One-line-jump scan set by the 1-line-jump scan sequencer 562 scans, for example, odd Y-electrodes and then even Y-electrodes in order of Y1, Y3, Y5, Y7, . . . , Y1021, and Y1023, and then, Y2, Y4, Y6, Y8, . . . , Y1022, and Y1024.

Figure 18:
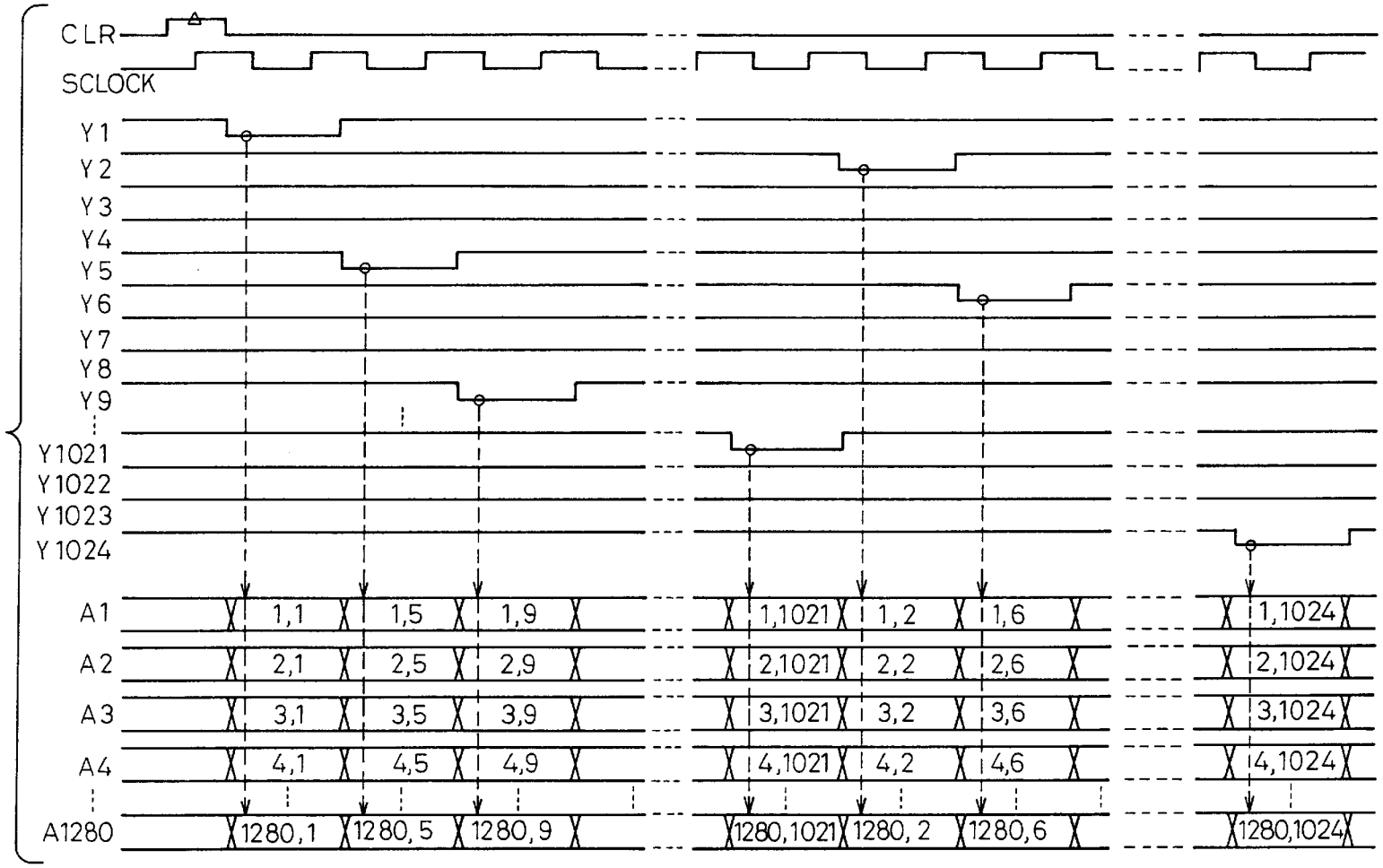
FIG. 18 is a timing chart showing a 3-line-jump operation of the display of FIG. 17.

FIG. 18 is a timing chart showing 3-line-jump scan set by the 3-line-jump scan sequencer 563.

This sequence scans the Y-electrodes in order of Y1, Y5, Y9, Y13, . . . , Y1017, and Y1021, then, Y2, Y6, Y10, Y14, . . . , Y1018, and Y1022, then, Y3, Y7, Y11, Y15, . Y1019, and Y1023, and then, Y4, Y8, Y12, Y16, . . . , Y1020, and Y1024. For every Y-electrode to be scanned, the A-driver 52 applies proper display data to the A-electrodes A1 to A1280.

Figure 19:
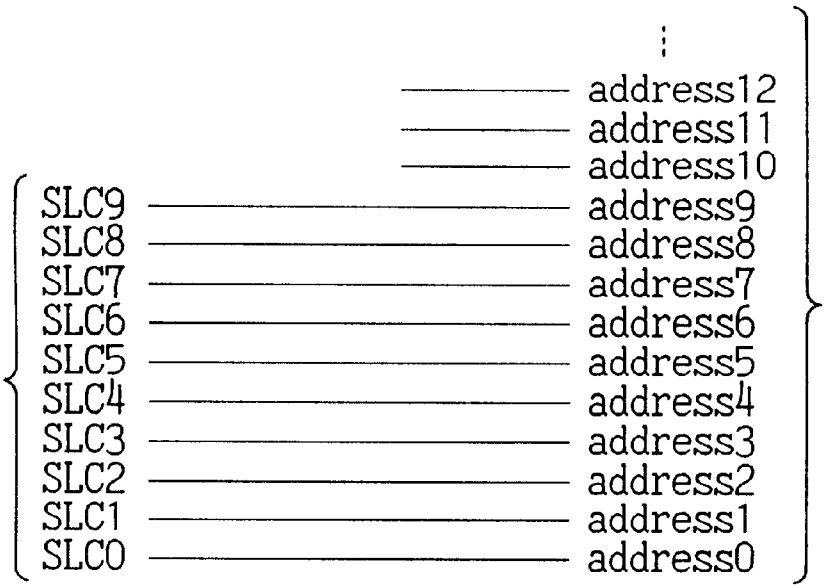
FIG. 19 shows the operation of a sequential address generator of the display of FIG. 17.
Figure 20:
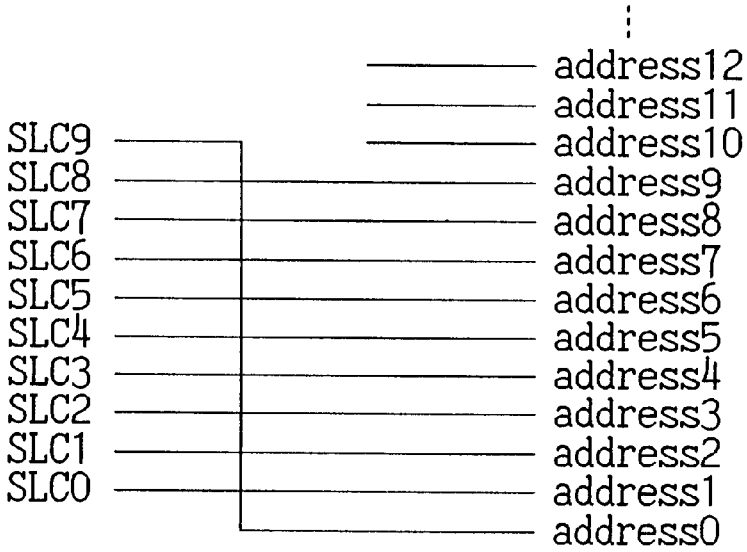
FIG. 20 shows the operation of a 1-line-jump address generator of the display of FIG. 17.
Figure 21:
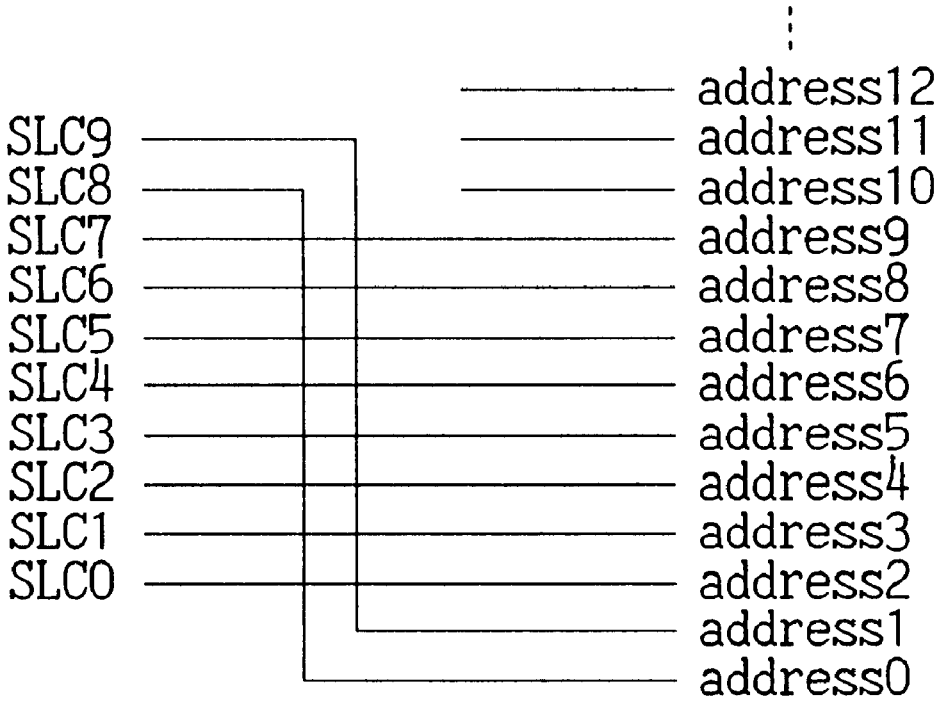
FIG. 21 shows the operation of a 3-line-jump address generator of the display of FIG. 17.

FIG. 19 shows the operation of the sequential address generator 551, FIG. 20 the operation of the 1-line-jump address generator 552, and FIG. 21 the operation of the 3-line-jump address generator 553. In FIGS. 19 to 21, 10 bits SLC0 to SLC9 are provided by the counter 54 for the 1024 Y-electrodes Y1 to Y1024. There are address signals address0, address1, and the like.

In FIG. 19, the Y-electrodes Y1 to Y1024 are sequentially scanned in order of Y1, Y2, Y3, Y4, Y1023, and Y1024. The sequential address generator 551 uses the output signals SLC0 to SLC9 as they are to prepare the address signals address0 to address9. Higher address bits address10, address 11, and the like are determined according to sub-frame information, etc.

In FIG. 20, the Y-electrodes Y1 to Y1024 are scanned in odd-even order of Y1, Y3, Y5, Y7, . . . , Y1021, and Y1023, and then, Y2, Y4, Y6, Y8, . . . , Y1022, and Y1024. The 1-line-jump address generator 552 uses the output signals SLC0 to SLC8 to prepare the address signals address1 to address9, and the output signal SLC9 to prepare the address signal address0.

In FIG. 21, the Y-electrodes Y1 to Y1024 are scanned in order of Y1, Y5, Y9, Y13, . . . , Y1017, and Y1021, then, Y2, Y6, Y10, Y14, . . . , Y1018, and Y1022, then, Y3, Y7, Y11, Y15, . . . , Y1019, and Y1023, and them, Y4, Y8, Y12, Y16, . . . , Y1020, and Y1024. The 3-line-jump address generator 553 uses the output signals SLC0 to SLC7 to prepare the address signals address2 to address9, and the output signals SLC8 and SLC9 to prepare the address signals address0 and address1.

Figure 22:
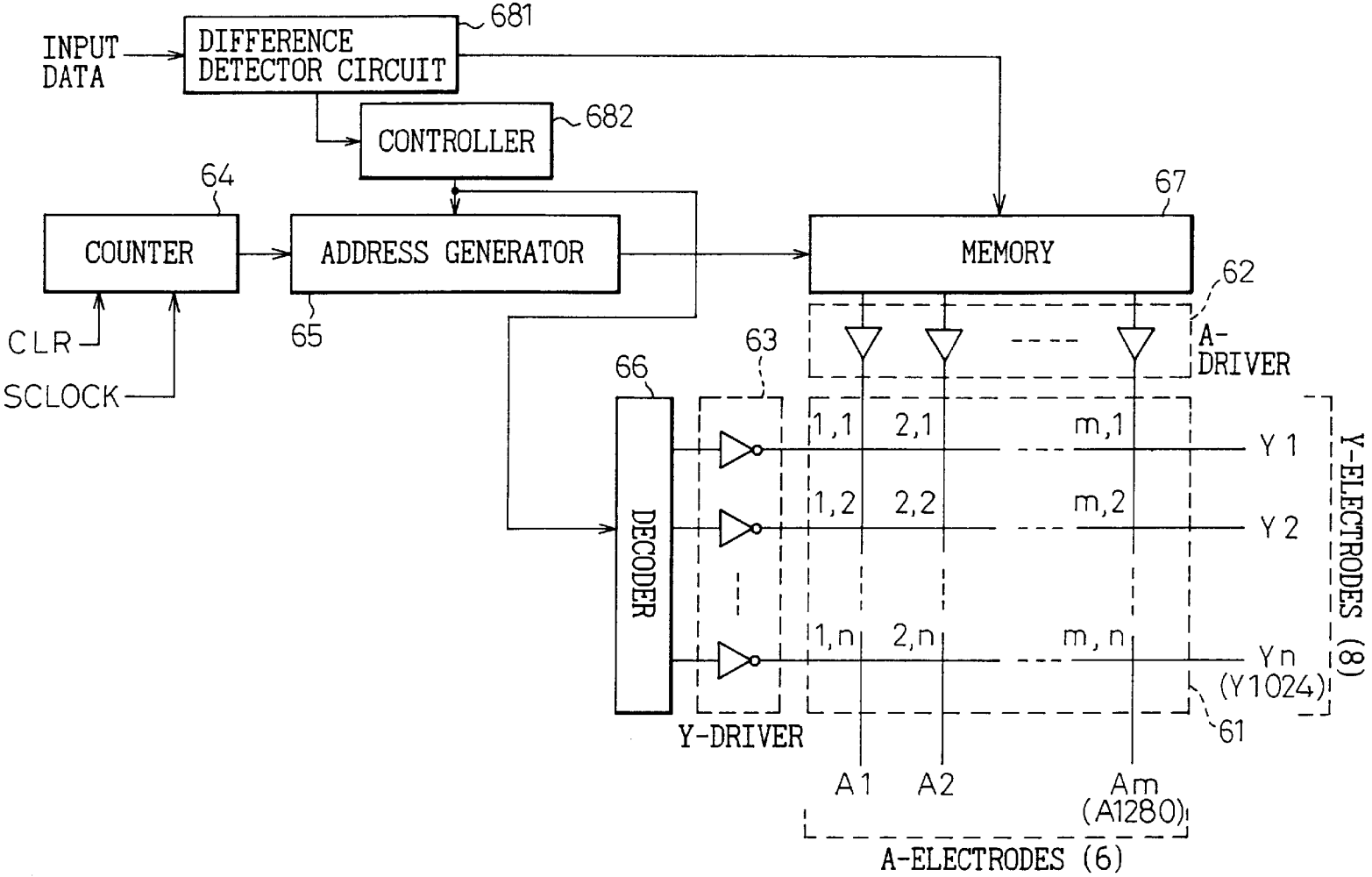
FIG. 22 is a block diagram showing a display according to a third embodiment of the present invention.

FIG. 22 is a block diagram showing a display according to the third embodiment of the present invention. The display has a panel 61, an address driver (A-driver) 62, a Y-driver 63, a counter 64, an address generator 65, a decoder 66, a memory 67, a difference detector circuit 681, and a controller 682.

The A-driver 62, Y-driver 63, and memory 67 correspond to the address driver 23, Y-driver 24, and frame memory 29 of FIG. 4. The decoder 66 is installed in the scan driver controller 21 of FIG. 4. The difference detector circuit 681, controller 682, counter 64, and address generator 65 are installed in the display data controller 28 of FIG. 4.

The display of the third embodiment is characterized in that the controller 682 is capable of optionally specifying a scan sequence. Display data is supplied to the difference detector circuit 681, which detects the difference between display data for a scan start line and display data for each of the other lines. Here, the lines correspond to Y-electrodes. The controller 682 determines a scan sequence so that the lines are scanned in ascending order of the differences between the scan start line and the other lines. Namely, EXORs are calculated among the display data for the lines, and any line involving a smaller number of 1s is scanned earlier.

According to the scan sequence determined by the controller 682, the decoder 66 selects a line to scan, and the address generator 65 outputs corresponding address signals. The panel 61 may be divided into blocks each having a predetermined number (for example, 4 or 8) of lines, to simplify the structure of FIG. 22.

Figure 23:
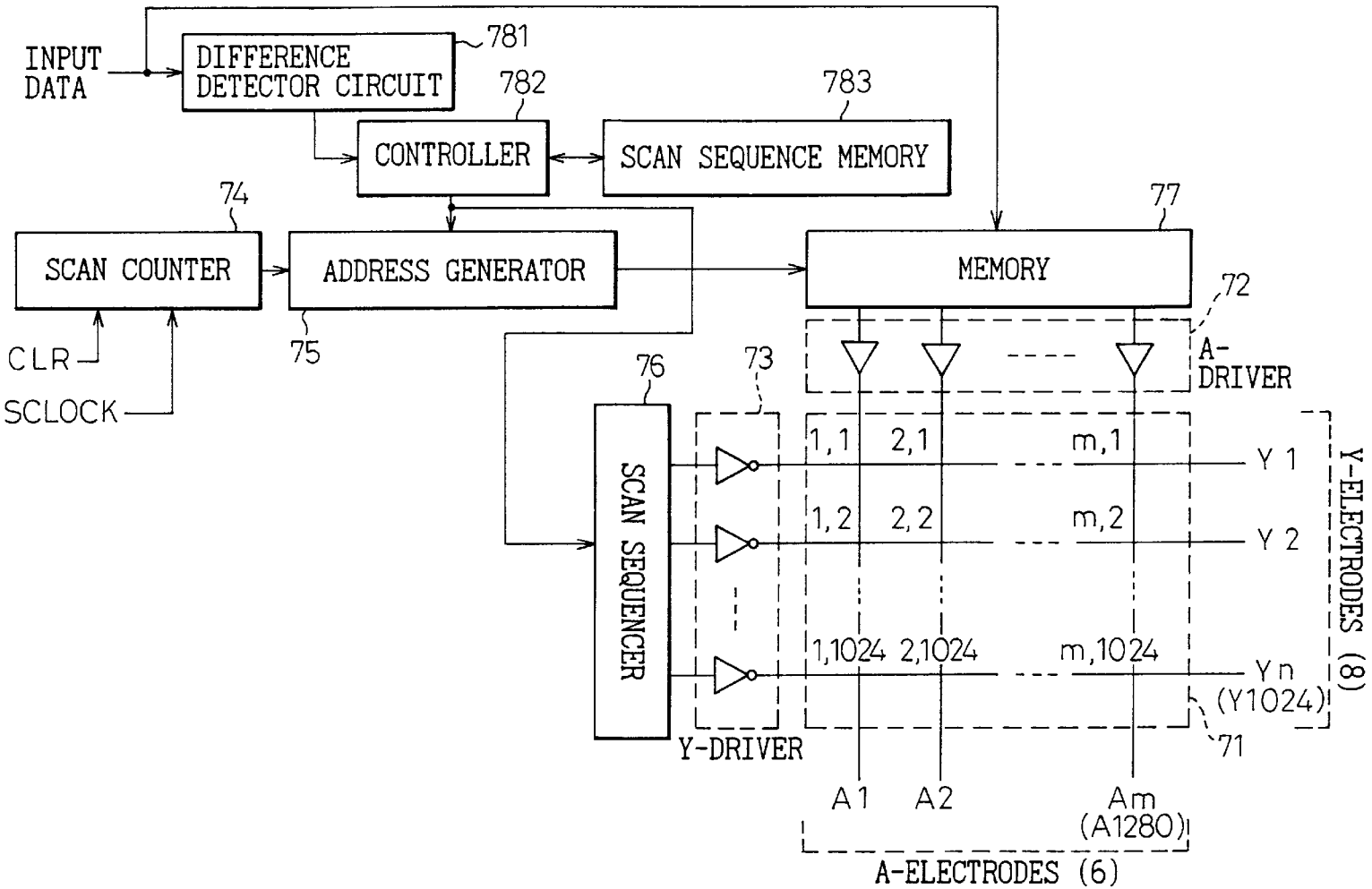
FIG. 23 is a block diagram showing a display according to a fourth embodiment of the present invention.

FIG. 23 is a block diagram showing a display according to the fourth embodiment of the present invention. This embodiment is based on the third embodiment of FIG. 22. A matrix panel 71 is divided into blocks in a scanning direction with each block containing four lines, i.e., four Y-electrodes. In each block, a scan sequence of the four lines is optimized.

The display of FIG. 23 has the panel 71, an address driver (A-driver) 72, a Y-driver 73, a scan counter 74, an address generator 75, a scan sequencer 76, a memory 77, a difference detector circuit 781, a controller 782, and a scan sequence memory 783.

The A-driver 72, Y-driver 73, and memory 77 correspond to the address driver 23, Y-driver 24, and frame memory 29 of FIG. 4. The scan sequencer 76 is installed in the scan driver controller 21 of FIG. 4. The difference detector circuit 781, controller 782, scan sequence memory 783, scan counter 74, and address generator 75 are installed in the display data controller 28 of FIG. 4.

Figure 24:
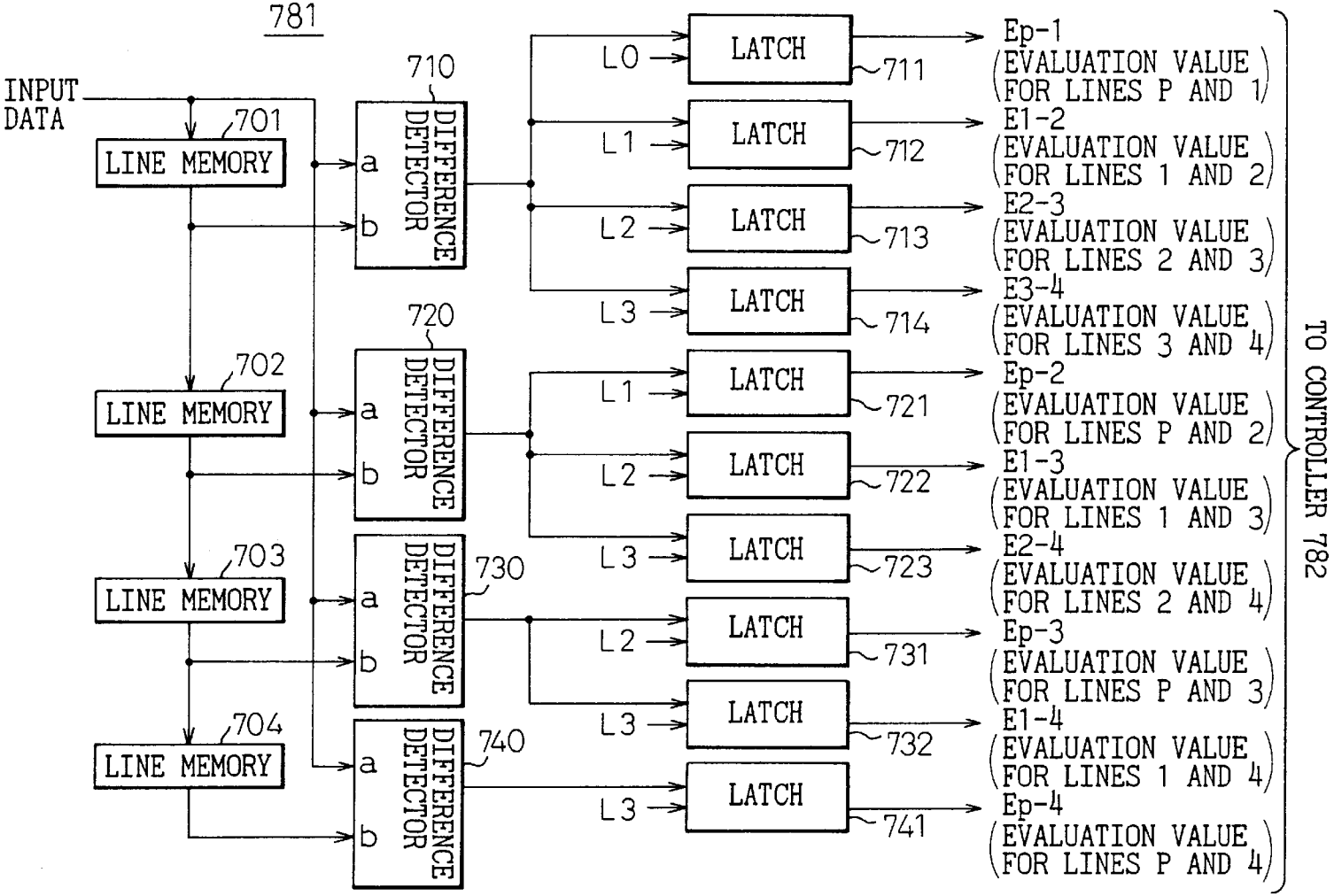
FIG. 24 is a block diagram showing a difference detector circuit of the display of FIG. 23.

FIG. 24 is a block diagram showing an example of the difference detector circuit 781.

The difference detector circuit 781 consists of four line memories 701 to 704 for storing display data for four consecutive lines, difference detectors 710 to 740 for detecting the differences between input display data and the display data stored in the line memories 701 to 704, and latches 711 to 714, 721 to 723, 731, 732, and 741 for latching the outputs of the difference detectors 710 to 740 in response to latch control signals (strobe signals) L0 to L3.

The line memories 701 to 704 receive display data for four consecutive lines and store them. The output of the difference detector 710 is latched by the four latches 711 to 714 in response to the latch control signals L0 to L3 each having different timing. The output of the difference detector 720 is latched by the three latches 721 to 723 in response to the latch control signals L1 to L3. The output of the difference detector 730 is latched by the two latches 731 and 732 in response to the latch control signals L2 and L3. The output of the difference detector 740 is latched by the latch circuit 741 in response to the latch control signal L3.

Figure 25:
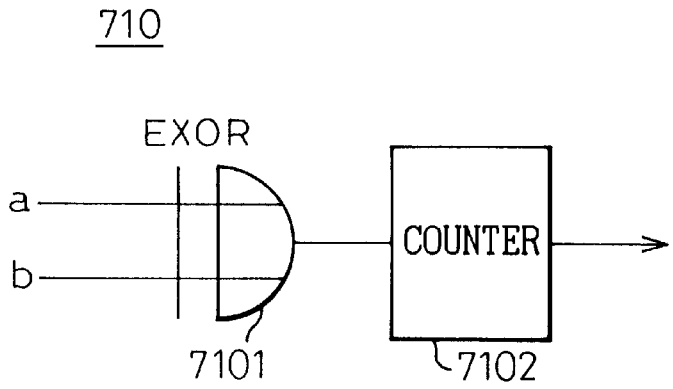
FIG. 25 is a block diagram showing a difference detector contained in the difference detector circuit of FIG. 24.

FIG. 25 is a block diagram showing an example of the difference detector 710. The other difference detectors 720 to 740 each have the same structure as the difference detector 710.

The difference detector 710 has an exclusive OR (EXOR) circuit 7101 and a counter 7102 to count the number of unequal bits between input display data (a) for one line and the output (b) of the line memory 701.

Figure 26:
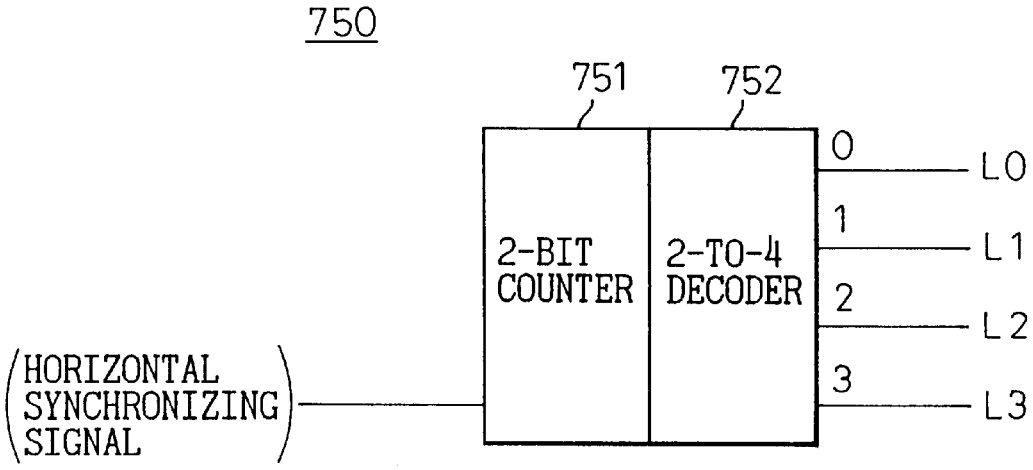
FIG. 26 shows a circuit for generating control signals for latches contained in the difference detector circuit of FIG. 24.

FIG. 26 shows a circuit for generating the latch control signals L0 to L3.

The latch signal generator 750 consists of a 2-bit counter 751 for receiving a horizontal synchronizing signal HSYNC and a 2-to-4 decoder 752 for converting a 2-bit signal into a 4-bit signal. Each of the latch control signals L0 to L3 is provided once in a period in which four lines are scanned. The signals L0 to L3 are shifted from one another by a one-line-scan period as shown in FIG. 27.

Figure 27:
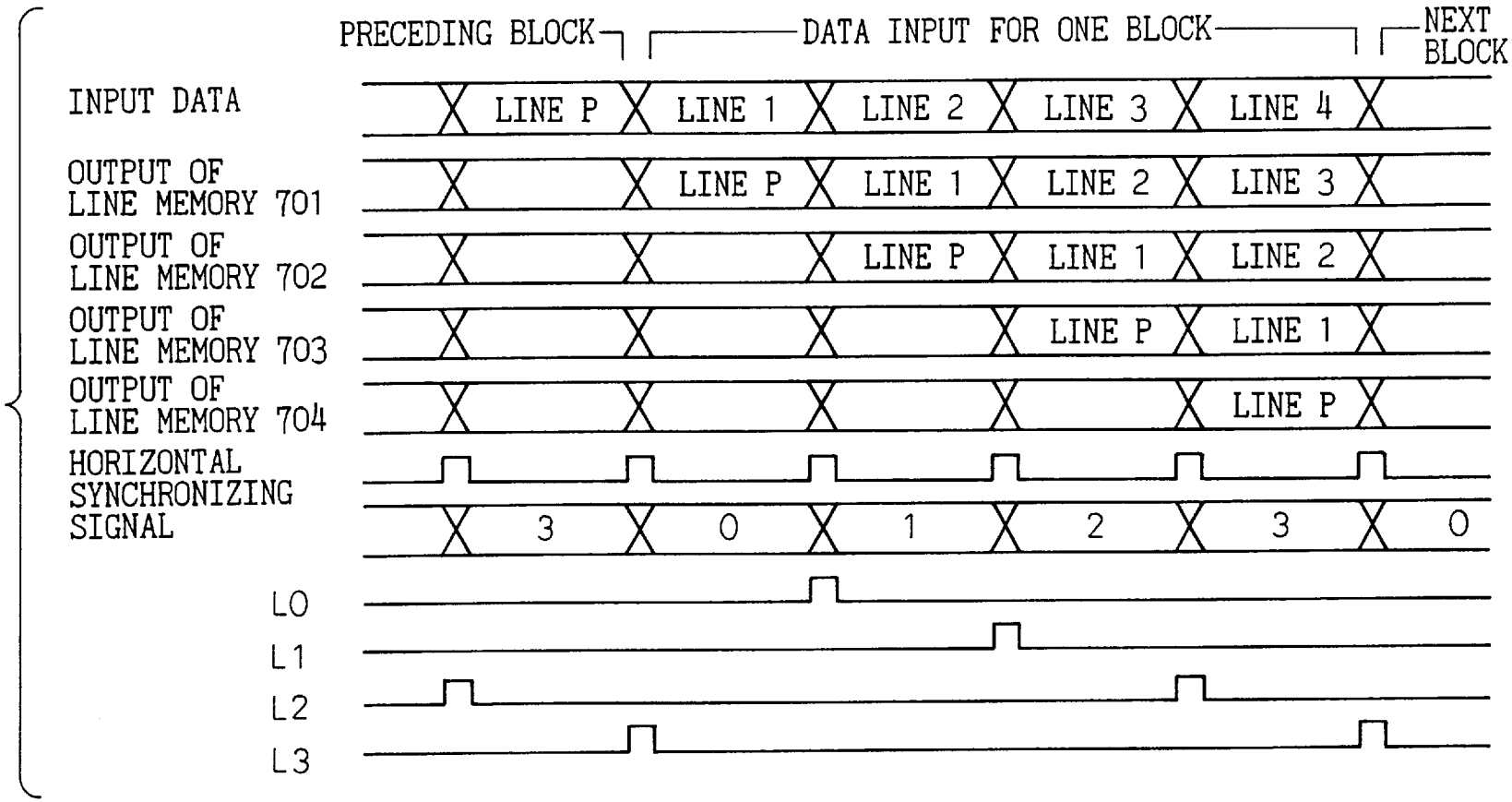
FIG. 27 is a timing chart showing the operation of the difference detector circuit of FIG. 24.

FIG. 27 is a timing chart showing the operation of the difference detector circuit 781.

The operations of the difference detector circuit 781 and display of the fourth embodiment will be explained with reference to FIG. 27.

The outputs of the difference detectors 710 to 740 are latched by the latches 711 to 714, 721 to 723, 731, 732, and 741 in response to the latch control signals L0 to L3. Here, a line "P" represents display data for the last line scanned in a block preceding a target block. The differences between the display data for the line P and display data for four lines 1 to 4 of the target block are detected, and one among the lines 1 to 4 that provides the smallest difference with respect to the line P will be the first scan line in the target block.

Once the first scan line in the target block is determined, one among the remaining three lines that has the smallest difference in display data with respect to the first scan line is selected as the second scan line. Similarly, a line having the smallest difference in display data with respect to the second scan line is selected as the third scan line. Then, the fourth scan line is determined. These processes are carried out on every block of display lines on the panel 71, to determine a scan sequence of four lines in every block. The scan sequences thus determined to cover all lines are stored in the scan sequence memory 783.

In FIG. 27, display data for the lines P, 1, 2, 3, and 4 are sequentially input. The line memory 701 delays these data pieces by one line period each time, i.e., one horizontal synchronizing period and outputs them one after another. The line memory 702 delays the data pieces by two line periods each time and outputs them one after another. The line memory 703 delays the data pieces by three line periods each time and outputs them one after another. The line memory 704 delays the data pieces by four line periods each time and outputs them one after another.

The input display data and the outputs of the line memories 701 to 704 are supplied to the difference detectors 710 to 740, which count and output unequal bits as explained with reference to FIG. 25. The outputs of the difference detectors 710 to 740 are latched by the latches 711 to 714, 721 to 723, 731, 732, and 741 in response to the latch control signals L0 to L3. More precisely, the latch 711 latches the difference in display data between the lines P and 1 in response to the latch control signal L0. Here, the line P is the last line scanned in the preceding block, and the line 1 is the first line scanned in the target block. The latch circuit 712 latches the difference in display data between the lines 1 and 2 in the target block in response to the latch control signal L1. The latch circuit 713 latches the difference in display data between the lines 2 and 3 in the target block in response to the latch control signal L2. The latch circuit 714 latches the difference in display data between the lines 3 and 4 in the target block in response to the latch control signal L3.

Similarly, the latch circuit 721 latches the difference in display data between the lines P and 2 in response to the latch control signal L1. The latch circuit 722 latches the difference in display data between the lines 1 and 3 in response to the latch control signal L2. The latch circuit 723 latches the difference in display data between the lines 2 and 4 in response to the latch control signal L3. In this way, the difference in display data between optional two of the lines P and 1 to 4 is detected and evaluated to determine a scan sequence that minimizes current and power consumption. After a scan sequence of four lines in every block is determined, the determined scan sequences that cover all lines are stored in the scan sequence memory 783.

The controller 782 reads the scan sequences out of the memory 783 and controls the scan sequencer 76 and address generator 75, to scan the Y-electrodes through the Y-driver 73 according to the scan sequences. At the same time, the controller 782 provides the A-electrodes with proper display data through the memory 77 and A-driver 72 according to the scan sequences.

Figure 28:
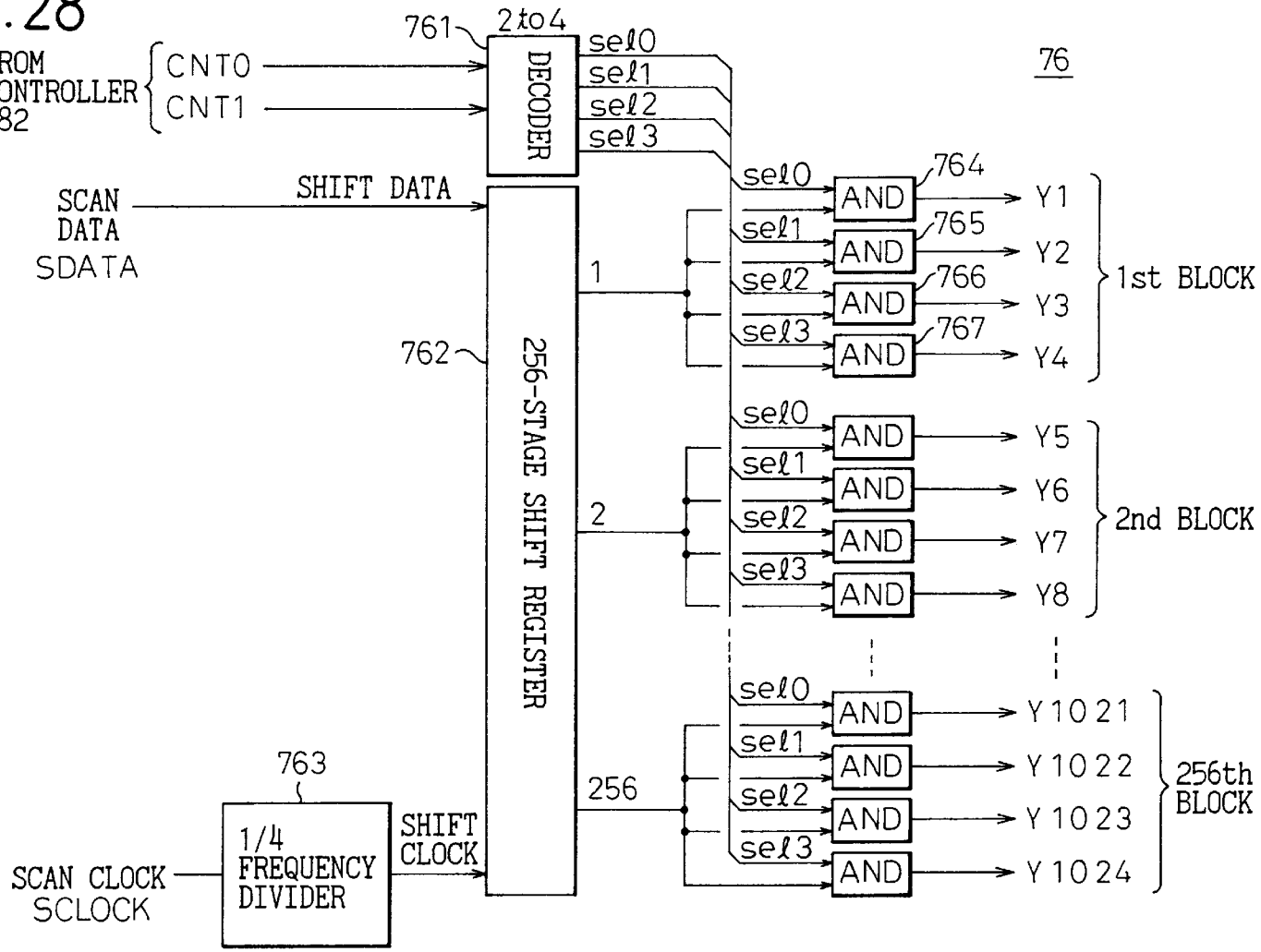
FIG. 28 is a block diagram showing a scan sequencer of the display of FIG. 23.

FIG. 28 is a block diagram showing an example of the scan sequencer 76 of FIG. 23.

The scan sequencer 76 has a 2-to-4 decoder 761 for converting a 2-bit signal into a 4-bit signal, a 256 stage shift register 762, a ¼ frequency divider 763 for quartering the frequency of the scan clock signal SCLOCK, i.e., quadrupling the period of the signal SCLOCK, and AND circuits 764 to 767 for providing ANDs of the output signals se10 to se13 of the decoder 761 and the outputs of the shift register 762 for each block. The 1024 Y-electrodes Y1 to Y1024 are divided into 256 blocks each containing four Y-electrodes. Accordingly, the shift register 762 sequentially scans the 256 blocks at the ¼ frequency of the scan clock signal SCLOCK.

When a block is scanned by the shift register 762, the scanning sequence of four lines of the block is controlled according to the four control signals se10 to se13 that are prepared by decoding control signals CNT0 and CNT1 provided by the controller 782. At this time, the scanning sequence of four lines of each block is determined to minimize the current and power consumption of the A-driver 72.

Figure 29:
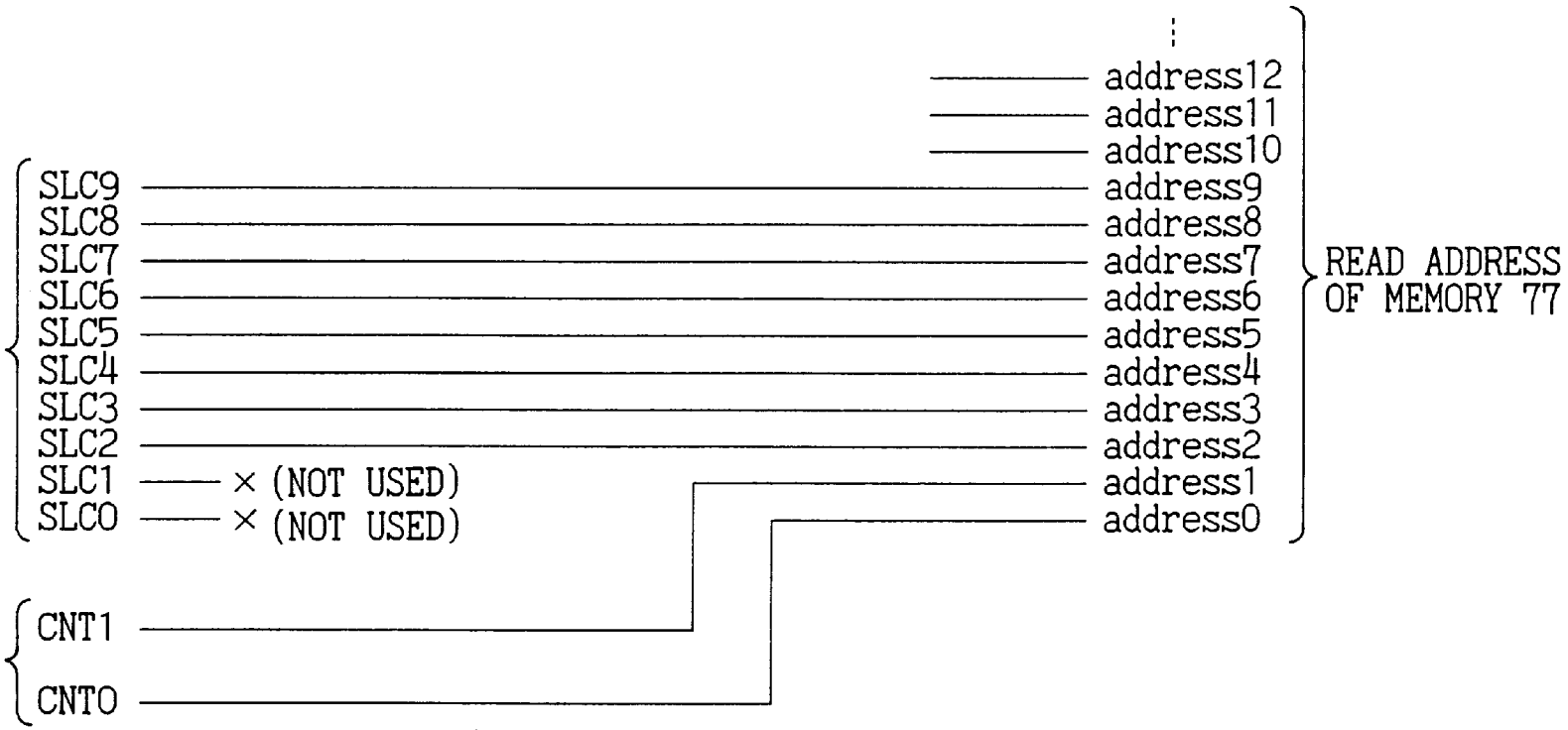
FIG. 29 shows the operation of an address generator of the display of FIG. 23.

FIG. 29 shows the operation of the address generator 75 of FIG. 23.

The address generator 75 uses output signals SLC2 to SLC9 of the scan counter 74 as they are to provide address signals address2 to address9, and uses the control signals CNT0 and CNT1 from the controller 782 to prepare address signals address0 and address1. Output signals SLC0 and SLC1 of the scan counter 74 are not used.

As a result, the A-driver 72 provides the addressing electrodes A1 to A1280 with display data corresponding to one of the Y-electrodes Y1 to Y1024 selected by the scan sequencer 76.

The embodiments mentioned above may be combined in various ways. Although the embodiments relate to 3-electrode, surface-discharge AC PDP displays, the present invention is applicable to a variety of matrix-electrode-scanning displays such as PDP displays, EL displays, LCDs, VFDs, and LED displays.

As explained above, the displays and display driving methods of the present invention are capable of reducing the current and power consumption of an address driver without deteriorating the quality of images to display.

Many different embodiments of the present invention may be constructed without departing from the spirit and scope of the present invention, and it should be understood that the present invention is not limited to the specific embodiments described in this specification, except as defined in the appended claims.

What is claimed is:

1. A display having a panel, and first and second electrodes, the first and second electrodes defining a matrix of cells on the panel, the second electrodes, which correspond to lines of the cells, being scanned to select cell lines, the first electrodes being driven to set display data for a selected one of the cell lines, wherein said display comprises:

a sequence setting unit setting a plurality of sequences of scanning the second electrodes;

a difference detection unit detecting differences between display data set for the cell lines;

an upper limit setting unit setting an upper limit; and a sequence selection unit selecting one of the sequences that suppresses the differences below the upper limit.

2. A display as claimed in claim 1, wherein the sequences are set based on powers of two.

3. A display as claimed in claim 1, wherein:

said sequence setting unit divides the second electrodes into blocks and sets sequences of scanning the second electrodes block by block; and said sequence selection unit selects one of the sequences in each of the blocks.

4. A display as claimed in claim 1, wherein said display further comprises:

an address driver driving the addressing electrodes;

a current/power value detection unit detecting a current or power value of said address driver; and a sequence changing unit changing a sequence of scanning the second electrodes.

5. A display as claimed in claim 4, wherein said display further comprises:

a current/power value evaluation unit evaluating a current or power value of said address driver according to display data set for the cell lines so that one of the sequences that minimizes the current or power value is selected.

6. A display as claimed in claim 4, wherein said display further comprises:

a reference value setting unit setting a reference value so that one of the sequences that suppresses the current or power value to below the reference value is selected.

7. A display as claimed in claim 4, wherein said display further comprises:

a current/power value evaluation unit evaluating a current or power value of said address driver according to display data set for the cell lines; and a reference value setting unit setting a reference value so that one of the sequences that suppresses the current or power value to below the reference value is selected.

8. A display as claimed in claim 4, wherein said display further comprises:

a current/power value evaluation unit evaluating a current or power value of said address driver beforehand according to display data set for the cell lines; and a reference value setting unit setting a reference value so that one of the sequences that suppresses the current or power value to below the reference value is selected.

9. A display as claimed in claim 1, wherein said display further comprises:

a display data supplying unit supplying display data line by line to the first electrodes according to the selected sequence of scanning the second electrodes.

10. A display as claimed in claim 1, wherein said display is a plasma display, a frame of display data is divided into a plurality of sub-frames that are selectively combined to display gradations, and each of the sub-frames at least includes an addressing period and a sustain period.

11. A display as claimed in claim 10, wherein the panel is a three-electrode surface-discharge alternating-current plasma display panel having third electrodes that run in parallel with the second electrodes and applying an alternating voltage to the second and third electrodes to repeat a sustain discharge.

12. A display as claimed in claim 1, wherein the first electrodes are addressing electrodes, and the second electrodes are scan electrodes.

13. A display having a panel, and first and second electrodes, the first and second electrodes defining a matrix of cells on the panel, the second electrodes, which correspond to lines of the cells, being scanned to select cell lines, the first electrodes being driven to set display data for a selected one of the cell lines, wherein said display comprises:

a difference detection unit detecting differences between display data set for the cell lines;

an upper limit setting unit setting an upper limit; and a sequence setting unit optionally setting a variable sequence of scanning the second electrodes that suppresses the differences below the upper limit.

14. A display as claimed in claim 13, wherein said sequence setting unit divides the second electrodes into blocks and sets a sequence of scanning the second electrodes in each of the blocks.

15. A display as claimed in claim 13, wherein said display further comprises:

an address driver driving the addressing electrodes;

a current/power detection unit detecting a current or power value of said address driver; and a sequence changing unit changing a sequence of scanning the second electrodes to minimize the current or power value.

16. A display as claimed in claim 15, wherein said display further comprises:

a current/power evaluation unit evaluating a current or power value of said address driver according to display data set for the cell lines so that the second electrodes are scanned in a sequence to minimize the current or power value.

17. A display as claimed in claim 15, wherein said display further comprises:

a reference value setting unit setting a reference value so that the second electrodes are scanned in a sequence to suppress the current or power value to below the reference value.

18. A display as claimed in claim 15, wherein said display further comprises:

a current/power evaluation unit evaluating a current or power value of said address driver according to display data set for the cell lines; and a reference value setting unit setting a reference value so that the second electrodes are scanned in a sequence to suppress the current or power value to below the reference value.

19. A display as claimed in claim 15, wherein said display further comprises:

a current/power evaluation unit evaluating a current or power value of said address driver beforehand according to display data set for the cell lines; and a reference value setting unit setting a reference value so that the second electrodes are scanned in a sequence to suppress the current or power value to below the reference value.

20. A display as claimed in claim 13, wherein said display further comprises:

a display data supplying unit supplying display data line by line to the first electrodes according to the determined sequence of scanning the second electrodes.

21. A display as claimed in claim 13, wherein said display is a plasma display, a frame of display data is divided into a plurality of sub-frames that are selectively combined to display gradations, and each of the sub-frames at least includes an addressing period and a sustain period.

22. A display as claimed in claim 21, wherein the panel is a three-electrode surface-discharge alternating current plasma display panel having third electrodes that run in parallel with the second electrodes and applying an alternating voltage to the second and third electrodes to repeat a sustain discharge.

23. A display as claimed in claim 13, wherein the first electrodes are addressing electrodes, and the second electrodes are scan electrodes.

24. A display having a panel, a plurality of addressing electrodes, and a plurality of scan electrodes, the addressing and scan electrodes defining a matrix of cells on the panel, the scan electrodes, which correspond to lines of the cells, being scanned according to a determined order, the addressing electrodes being driven to set display data for a selected one of the cell lines, said display comprising:

a sequence setting unit determining a plurality of different scanning orders for scanning the scan electrodes, each scanning order providing a different power consumption of a driver driving the addressing electrodes; and a sequence selection unit selecting one of the scanning orders providing a least power consumption.

25. A display having a panel, and addressing electrodes and scan electrodes, the addressing electrodes and the scan electrodes defining a matrix of cells on the panel, the scan electrodes, which correspond to lines of the cells, being scanned to select cell lines, the addressing electrodes being driven to set display data for a selected one of the cell lines, wherein said display comprises:

a sequence setting unit setting a plurality of sequences of scanning the scan electrodes;

an address driver driving the addressing electrodes;

a current/power value detection unit detecting a current or power value of said address driver;

a sequence selection unit selecting one of the sequences based on power consumption of the panel; and a sequence changing unit changing a sequence of scanning the scan electrodes.

26. A display as claimed in claim 25, wherein said display further comprises:

a current/power value evaluation unit evaluating a current or power value of said address driver according to display data set for the cell lines so that one of the sequences that minimizes the current or power value is selected.

27. A display as claimed in claim 25, wherein said display further comprises:

a reference value setting unit setting a reference value so that one of the sequences that suppresses the current or power value below the reference value is selected.

28. A display as claimed in claim 25, wherein said display further comprises:

a current/power value evaluation unit evaluating a current or power value of said address driver according to display data set for the cell lines; and a reference value setting unit setting a reference value so that one of the sequences that suppresses the current or power value below the reference value is selected.

29. A display as claimed in claim 25, wherein said display further comprises:

a current/power value evaluation unit evaluating a current or power value of said address driver beforehand according to display data set for the cell lines; and a reference value setting unit setting a reference value so that one of the sequences that suppresses the current or power value below the reference value is selected.

30. A display as claimed in claim 25, wherein said display further comprises:

a display data supplying unit supplying display data line by line to the addressing electrodes according to the selected sequence of scanning the scan electrodes.

31. A display having a panel, and addressing electrodes and scan electrodes, the addressing electrodes and the scan electrodes defining a matrix of cells on the panel, the scan electrodes, which correspond to lines of the cells, being scanned to select cell lines, the addressing electrodes being driven to set display data for a selected one of the cell lines, wherein said display comprises:

an address driver driving the addressing electrodes;

a current/power detection unit detecting a current or power value of said address driver;

a sequence setting unit optionally setting a variable sequence of scanning the scan electrodes based on power consumption of the panel; and a sequence changing unit changing a sequence of scanning the scan electrodes to minimize the current or power value.

32. A display as claimed in claim 31, wherein said display further comprises:

a current/power evaluation unit evaluating a current or power value of said address driver according to display data set for the cell lines so that the scan electrodes are scanned in a sequence to minimize the current or power value.

33. A display as claimed in claim 31, wherein said display further comprises:

a reference value setting unit setting a reference value so that the scan electrodes are scanned in a sequence to suppress the current or power value below the reference value.

34. A display as claimed in claim 31, wherein said display further comprises:

a current/power evaluation unit evaluating a current or power value of said address driver according to display data set for the cell lines; and a reference value setting unit setting a reference value so that the scan electrodes are scanned in a sequence to suppress the current or power value below the reference value.

35. A display as claimed in claim 31, wherein said display further comprises:

a current/power evaluation unit evaluating a current or power value of said address driver beforehand according to display data set for the cell lines; and a reference value setting unit setting a reference value so that the scan electrodes are scanned in a sequence to suppress the current or power value below the reference value.

36. A display as claimed in claim 31, wherein said display further comprises:

a display data supplying unit supplying display data line by line to the addressing electrodes according to the determined sequence of scanning the scan electrodes.

* * * * *